US012778369B2

(12) United States Patent
Park et al.

(10) Patent No.: US 12,778,369 B2
(45) Date of Patent: Nov. 3, 2026

(54) CLEANER SYSTEM AND CONTROL METHOD THEREFOR

(71) Applicant: LG Electronics Inc., Seoul (KR)

(72) Inventors: Heegu Park, Seoul (KR); Kietak Hyun, Seoul (KR); Jaeheon Chung, Seoul (KR); Daewoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/692,693

(22) PCT Filed: Sep. 14, 2022

(86) PCT No.: PCT/KR2022/013671
§ 371 (c)(1),
(2) Date: Mar. 15, 2024

(87) PCT Pub. No.: WO2023/043160
PCT Pub. Date: Mar. 23, 2023

(65) Prior Publication Data

US 2024/0285137 A1 Aug. 29, 2024

(30) Foreign Application Priority Data

Sep. 15, 2021 (KR) ..... 10-2021-0123455

(51) Int. Cl.
*A47L 9/14* (2006.01)
*A47L 9/00* (2006.01)
*A47L 9/24* (2006.01)

(52) U.S. Cl.
CPC ..... *A47L 9/149* (2013.01); *A47L 9/0063* (2013.01); *A47L 9/248* (2013.01)

(58) Field of Classification Search
CPC . A47L 5/24; A47L 5/26; A47L 9/0063; A47L 9/106; A47L 9/149; A47L 9/1683; A47L 9/248; A47L 9/2842; A47L 9/2873
See application file for complete search history.

(56) References Cited

U.S. PATENT DOCUMENTS

2018/0078107 A1* 3/2018 Gagnon ..... A47L 9/20
2021/0068603 A1* 3/2021 Cho ..... A47L 9/2857
2021/0259488 A1 8/2021 Cho et al.

FOREIGN PATENT DOCUMENTS

CN 205729241 11/2016
CN 113208500 8/2021
(Continued)

OTHER PUBLICATIONS

Machine translation of DE102012109938A1 (Year: 2014).*
(Continued)

*Primary Examiner* — Douglas Lee
(74) *Attorney, Agent, or Firm* — Fish & Richardson P.C.

(57) ABSTRACT

The present disclosure relates to a cleaner system and a method of controlling the same, the cleaner system including a cleaner including a dust bin configured to collect dust, and a cleaner station to which the cleaner is coupled, in which the cleaner includes a suction motor configured to generate a suction force to the dust bin, a suction force of the suction motor is changed at least one or more times, and a flow direction of the dust in a flow path part connected to the dust bin is changed reversely at least one or more times, such that when debris firmly caught by the dust bin has strong resistance against an airflow in one direction, an airflow may be applied in the opposite direction to effectively remove the debris.

14 Claims, 17 Drawing Sheets

(56) References Cited

FOREIGN PATENT DOCUMENTS

| | | | | |
|---|---|---|---|---|
| DE | 102012109938 A1 * | 4/2014 | ..... | A47L 9/2831 |
| JP | 2020142066 | 9/2020 | | |
| KR | 102208334 | 1/2021 | | |
| KR | 20210019940 | 2/2021 | | |

OTHER PUBLICATIONS

International Search Report and Written Opinion in International Appln. No. PCT/KR2022/013671, mailed on Jan. 6, 2023, 19 pages (with English translation).
Extended European Search Report in European Appln. No. 22870244.5, mailed on May 21, 2026, 6 pages.

* cited by examiner

CLEANER SYSTEM AND CONTROL METHOD THEREFOR

CROSS-REFERENCE TO RELATED APPLICATIONS

This application is a National Stage application under 35 U.S.C. § 371 of International Application No. PCT/KR2022/013671, filed on Sep. 14, 2022, which claims the benefit of Korean Application No. 10-2021-0123455, filed on Sep. 15, 2021. The disclosures of the prior applications are incorporated by reference in their entirety.

TECHNICAL FIELD

The present disclosure relates to a cleaner system and a method of controlling the same, and more particularly, to a cleaner system, which includes a cleaner configured to suck outside dust, and a cleaner station configured to suck dust, which is stored in the cleaner, into the cleaner station, and a method of controlling the same.

BACKGROUND ART

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The handy cleaner (hand vacuum cleaner) has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach. Recently, modularized stick cleaners are provided, such that types of cleaners are actively changed and used to clean various places.

In addition, recently, a robot cleaner, which autonomously performs a cleaning operation without a user's manipulation, is used. The robot cleaner automatically cleans a zone to be cleaned by sucking debris such as dust from the floor while autonomously traveling in the zone to be cleaned.

However, because the handy cleaner, the stick cleaner, or the robot cleaner in the related art has a dust bin with a small capacity for storing collected dust, which inconveniences the user because the user needs to empty the dust bin frequently.

In addition, because the dust scatters during the process of emptying the dust bin, there is a problem in that the scattering dust has a harmful effect on the user's health.

In addition, if residual dust is not removed from the dust bin, there is a problem in that a suction force of the cleaner deteriorates.

In addition, if the residual dust is not removed from the dust bin, there is a problem in that the residual dust causes an offensive odor.

Patent Document 1 discloses a cleaning apparatus including a vacuum cleaner and a docking station.

The cleaning apparatus disclosed in Patent Document 1 includes the vacuum cleaner including a dust collecting container for collecting debris, and the docking station connected to the dust collecting container and configured to remove the debris collected in the dust collecting container. The dust collecting container is configured to be docked to the docking station, and the docking station includes a suction device configured to suck debris and inside air in the dust collecting container docked to the docking station.

In addition, Patent Document 1 includes the capturing part disposed in the docking station and configured to capture debris. According to Patent Document 1, when the suction device disposed in the docking station operates, the suction device generates a negative pressure to suck debris collected in the dust collecting container and collects the debris in the capturing part, thereby cleaning the dust collecting container of the cleaner.

In general, the cleaner is generally placed and used in the home. Various types of debris are present in the home, and hairs often appear. In particular, because hairs are thin and long, the hairs are sometimes caught by one side of the dust collecting container while the hairs are collected in the dust collecting container of the cleaner.

When the suction device of the docking station operates in the state in which the hair is caught by one side of the dust collecting container as described above, the hair elongates toward the docking station in a state in which one side of the hair is caught by the dust collecting container and the other side of the hair extends toward the inside of the docking station, as a result, the hair cannot be collected by the capturing part. For this reason, there is a problem in that the hair needs to be separately removed.

Meanwhile, the docking station may have a device configured to automatically close a dust bin cover. However, because the hair extends to the outside of the dust bin in the state in which one side of the hair is caught by the dust collecting container as described above, the hair is trapped between the cover and the dust collecting container when the cover is closed, which causes a problem in that the dust collecting container cannot be completely sealed.

Patent Document 2 discloses a cleaning apparatus including a vacuum cleaner and a docking station, and a method of controlling the same.

Patent Document 2 provides the cleaning apparatus including the docking station that provides an irregular suction airflow to automatically and effectively discharge debris in a dust collecting container of the cleaner.

In order to achieve the above-mentioned object, Patent Document 2 provides a suction device configured to move air into the docking station from the dust collecting container of the dust bin, and a flow rate adjustment device configured to open or close a suction flow path. A control unit operates the suction device or controls the flow rate adjustment device to periodically open or close the suction flow path in the state in which the suction device operates. According to Patent Document 2, an irregular airflow occurs in the flow path as the flow path is opened or closed by the flow rate adjustment device, and the irregular airflow more efficiently discharges dust.

However, the debris such as hairs firmly caught in the dust bin may not be removed by the irregular airflow generated according to Patent Document 2.

Patent Document 3 discloses a cleaning system configured to remove dust from a robot cleaner.

Patent Document 3 provides a station, a handy cleaner coupled to one side of the station, and the robot cleaner is coupled to the other side of the station. A dust bin of the robot cleaner and a dust bin of the handy cleaner communicate with each other. When a suction motor of the robot cleaner operates, dust collected in the dust bin of the robot cleaner is moved to the handy cleaner, such that the dust bin of the robot cleaner is emptied.

However, even in Patent Document 3, a flow direction of dust is maintained as one direction. For this reason, there is a problem in that the debris such as hairs firmly caught by the dust bin cannot be removed even in Patent Document 3.

DISCLOSURE

Technical Problem

The present disclosure has been made in an effort to solve the above-mentioned problem with the cleaner system and the method of controlling the same in the related art. Specifically, in the related art, in case that debris, such as hairs, is firmly caught by a dust bin, the caught debris is not released when a suction air flow is maintained as one direction even though an irregular suction air flow is formed. Accordingly, an object of the present disclosure is to provide a cleaner system that may change a direction of airflow to a forward direction and a reverse direction, thereby removing debris firmly caught by a dust bin of a cleaner and more effectively emptying the dust bin.

Another object of the present disclosure is to provide a cleaner system that may collect dust, which remains around a discharge port of a dust bin, into the dust bin in a case in which long debris, such as hairs, is firmly caught, to a degree to which the debris cannot be separated, and remains around the discharge port of the dust bin, thereby completely sealing the dust bin when a discharge cover closes the discharge port.

Still another object of the present disclosure is to provide a method of controlling a cleaner system, which may control components of a cleaner or a cleaner station, thereby removing dust remaining around a discharge port of a dust bin.

Yet another object of the present disclosure is to provide a cleaner system and a method of controlling the same, which are capable of performing control to improve a lifespan of a suction motor or a dust collecting motor during a process of removing dust remaining around a discharge port of a dust bin.

Still yet another object of the present disclosure is to provide a cleaner system and a method of controlling the same, which are capable of efficiently collecting dust by operating a suction motor at a low rotational speed during a process of removing dust remaining around a discharge port of a dust bin.

Technical problems of the present disclosure are not limited to the aforementioned technical problems, and other technical problems, which are not mentioned above, may be clearly understood by those skilled in the art from the following descriptions.

Technical Solution

In order to achieve the above-mentioned object, a cleaner system according to the present disclosure includes: a cleaner including a dust bin configured to collect dust; and a cleaner station to which the cleaner is coupled. The cleaner includes a suction motor configured to generate a suction force so that air containing dust is introduced into the dust bin. The cleaner station includes: a housing having a coupling part to which the cleaner is coupled, the housing having an internal space configured to accommodate a flow path part through which the dust in the dust bin flows; and a dust collecting motor disposed at a downstream side of the flow path part and configured to provide a suction force to the dust bin through the flow path part. In this case, a suction force of the suction motor changes at least one or more times, and a flow direction of the dust in flow path part changes reversely at least one or more times.

In the cleaner system, at least any one of the suction motor and the dust collecting motor may be controlled by being turned on or off.

After the operation of the dust collecting motor is started, the suction force may change at least one or more times.

A direction of the suction force provided to the dust bin by the suction motor may be opposite to a direction of the suction force provided to the dust bin by the dust collecting motor.

The cleaner station may include a dust passing hole formed in the coupling part, to which the cleaner is coupled, and disposed between the dust bin and the flow path part, and a door configured to open or close the dust passing hole. In this case, the door may operate before at least any one of the suction motor and the dust collecting motor operates.

The door may operate to completely open the dust passing hole before the dust collecting motor operates. The door may operate to open only a part of the dust passing hole before the suction motor operates after the dust passing hole is completely opened.

According to the first embodiment of the present disclosure, the dust collecting motor may consistently operate, and the suction motor may be controlled by being turned on or off. In this case, when an operation mode is changed, the suction motor may begin to operate after the dust collecting motor operates.

According to the second embodiment of the present disclosure, the dust collecting motor may be controlled by being turned on or off, and the suction motor may consistently operate.

A rotational speed of the suction motor may include a first suction speed and a second suction speed lower than the first suction speed.

According to the third embodiment of the present disclosure, the first suction speed and the second suction speed of the suction motor may be alternately implemented, and the suction motor may be turned off for a predetermined time before the rotational speed is changed. In this case, the dust collecting motor may operate while the suction motor is turned off.

According to the fourth embodiment of the present disclosure, the first suction speed and the second suction speed of the suction motor are alternately implemented, and the rotational speed may be continuously changed for a predetermined time when the rotational speed is changed. In this case, a rotational speed of the dust collecting motor may be lower than the first suction speed.

In order to achieve the above-mentioned object, the present disclosure provides a method of controlling a cleaner system including a cleaner including a dust bin, and a suction motor configured to provide a suction force so that air containing dust is introduced into the dust bin, and a cleaner station including a coupling part to which the cleaner is coupled, a flow path part through which the dust in the dust bin flows when the cleaner is coupled, and a dust collecting motor disposed at a downstream side of the flow path part and configured to provide a suction force to the dust bin through the flow path part. The method of controlling the cleaner system includes: a dust collecting step of sucking the dust in the dust bin into the cleaner station by operating the dust collecting motor; and a recovery step of sucking dust, which is present in a discharge port of the dust bin, into the dust bin by operating the suction motor after the dust collecting step. In this case, in the recovery step, a flow direction is opposite to a flow direction in the flow path part in the dust collecting step.

The method of controlling the cleaner system may include a complete door opening step of completely opening the dust passing hole before the dust collecting step, and a partial door opening step of partially opening the dust passing hole before the suction motor operates in the recovery step. In this case, the dust passing hole is formed in the coupling part and disposed between the dust bin and the flow path part.

In order to achieve the above-mentioned object, a cleaner according to the present disclosure includes: a dust bin configured to collect dust; and a suction motor configured to generate a suction force so that air containing the dust is introduced into the dust bin. The cleaner is configured to be coupled to a cleaner station including a flow path part configured to communicate with the dust bin, and a dust collecting motor configured to generate air in the flow path part, When the dust collecting motor of the cleaner operates, an airflow is formed in a first direction in the flow path part. When the suction motor operates, an airflow is formed in a second direction opposite to the first direction in the flow path part.

The suction motor may operate after the dust collecting motor operates at least once.

The dust passing hole may be disposed between the dust bin and the flow path part, and a size of a cross-sectional area of the dust passing hole may be changed before the flow direction of the dust is changed.

The suction force of the suction motor may be changed so that the flow direction in the flow path part is changed.

Advantageous Effects

The cleaner system and the method of controlling the same according to the present disclosure described above have one or more of the following effects.

First, the dust is sucked into the cleaner station in the dust collecting step, the dust is sucked and recovered back into the dust bin in the recovery step, and the flow direction changes at least one or more times. When debris firmly caught by the dust bin in the dust collecting step has strong resistance against the airflow in the forward direction, the airflow may be applied in the reverse direction in the recovery step, thereby effectively removing the debris.

Second, the dust is sucked into the cleaner station in the dust collecting step, and the dust, which remains in the discharge port of the dust bin of the cleaner, is sucked and recovered back into the dust bin in the recovery step, such that the dust, such as hairs, caught by one side of the dust bin and extending to the discharge port of the dust bin may be recovered back into the dust bin. Therefore, it is possible to completely seal the dust bin when the discharge cover covers the discharge port of the dust bin.

Third, before the recovery step, the door unit operates to reduce the area of the dust passage hole. Therefore, even though the flow velocity increases in the dust passage hole and the suction motor operates at a low rotational speed, the dust remaining around the discharge port may be effectively removed. Therefore, it is possible to efficiently utilize power.

Fourth, the suction motor or the dust collecting motor is controlled by being turned on or off or by changing the rotational speeds. Therefore, it is possible to remove the dust remaining around the discharge port of the dust bin by changing the direction of the flow path by means of the simple control method.

The effects of the present disclosure are not limited to the aforementioned effects, and other effects, which are not mentioned above, will be clearly understood by those skilled in the art from the claims.

BEST MODE

Figure 1:
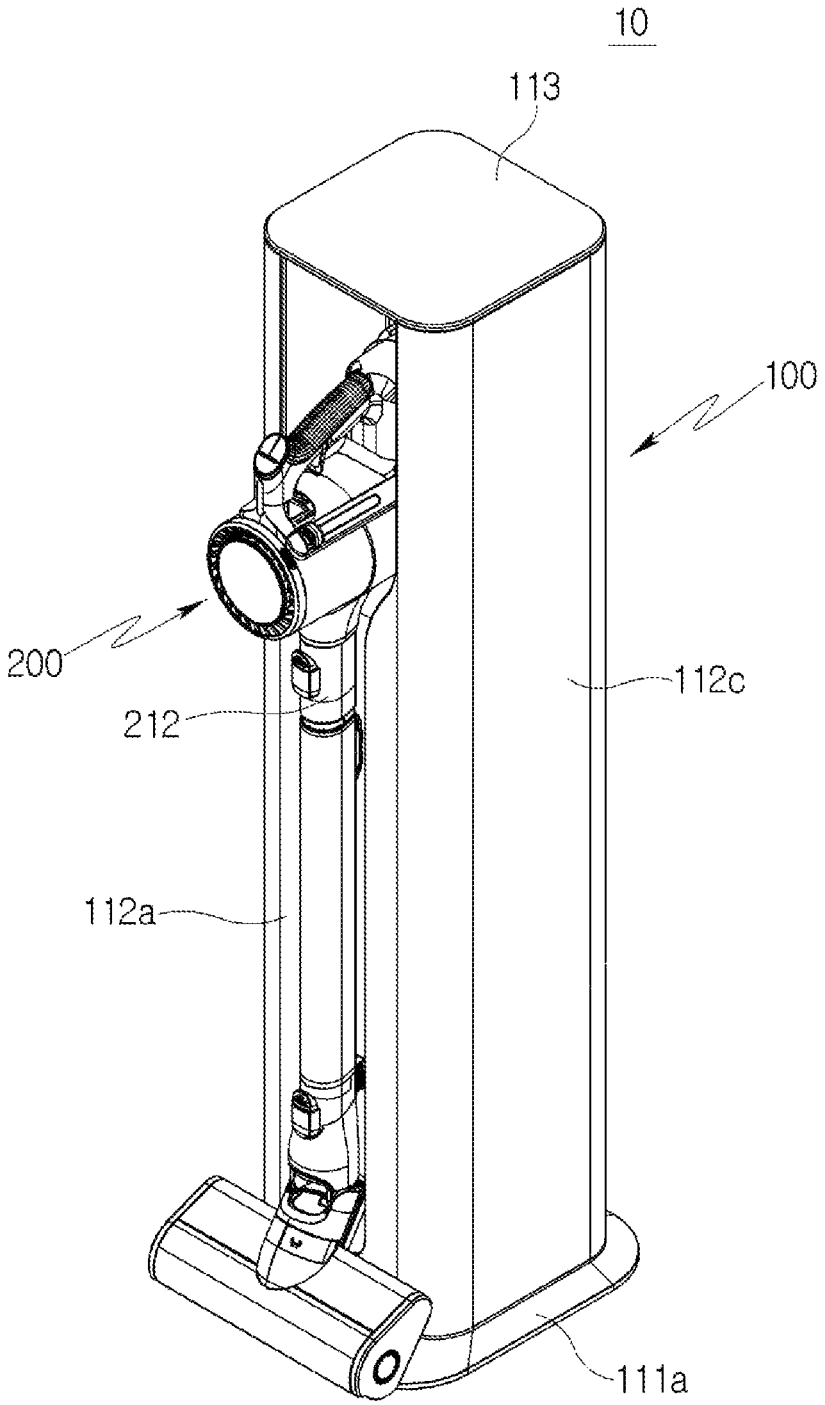
FIG. 1 is a perspective view of a cleaner system including a cleaner station and a cleaner according to an embodiment of the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

The terminology used herein is used for the purpose of describing particular embodiments only and is not intended to limit the present disclosure. Singular expressions may include plural expressions unless clearly described as different meanings in the context.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Figure 2:
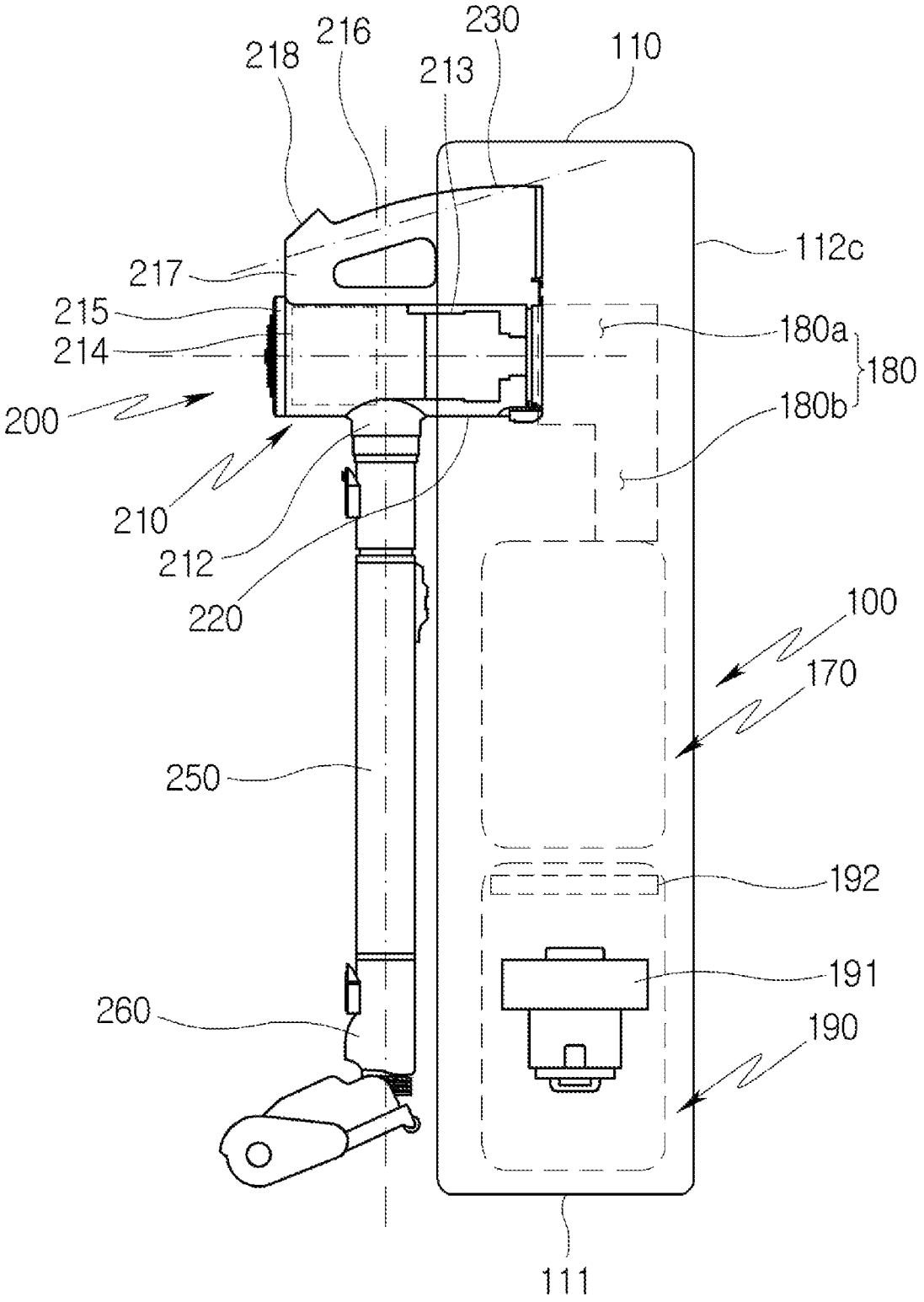
FIG. 2 is a schematic view illustrating a configuration of the cleaner system according to the embodiment of the present disclosure.

FIG. 1 is a perspective view illustrating a cleaner system including a cleaner station and a cleaner according to an embodiment of the present disclosure, and FIG. 2 is a schematic view illustrating a configuration of the cleaner system according to the embodiment of the present disclosure.

With reference to FIGS. 1 and 2, a cleaner system 10 according to an embodiment of the present specification may include a cleaner station 100 and a cleaner 200. Meanwhile, the present embodiment may be carried out without some of the above-mentioned components and does not exclude additional components.

The cleaner system 10 may include the cleaner station 100. The cleaner 200 may be coupled to the cleaner station 100. Specifically, the cleaner 200 may be coupled to a lateral side of the cleaner station 100. The cleaner station 100 may remove dust from a dust bin 220 of the cleaner 200.

Figure 3:
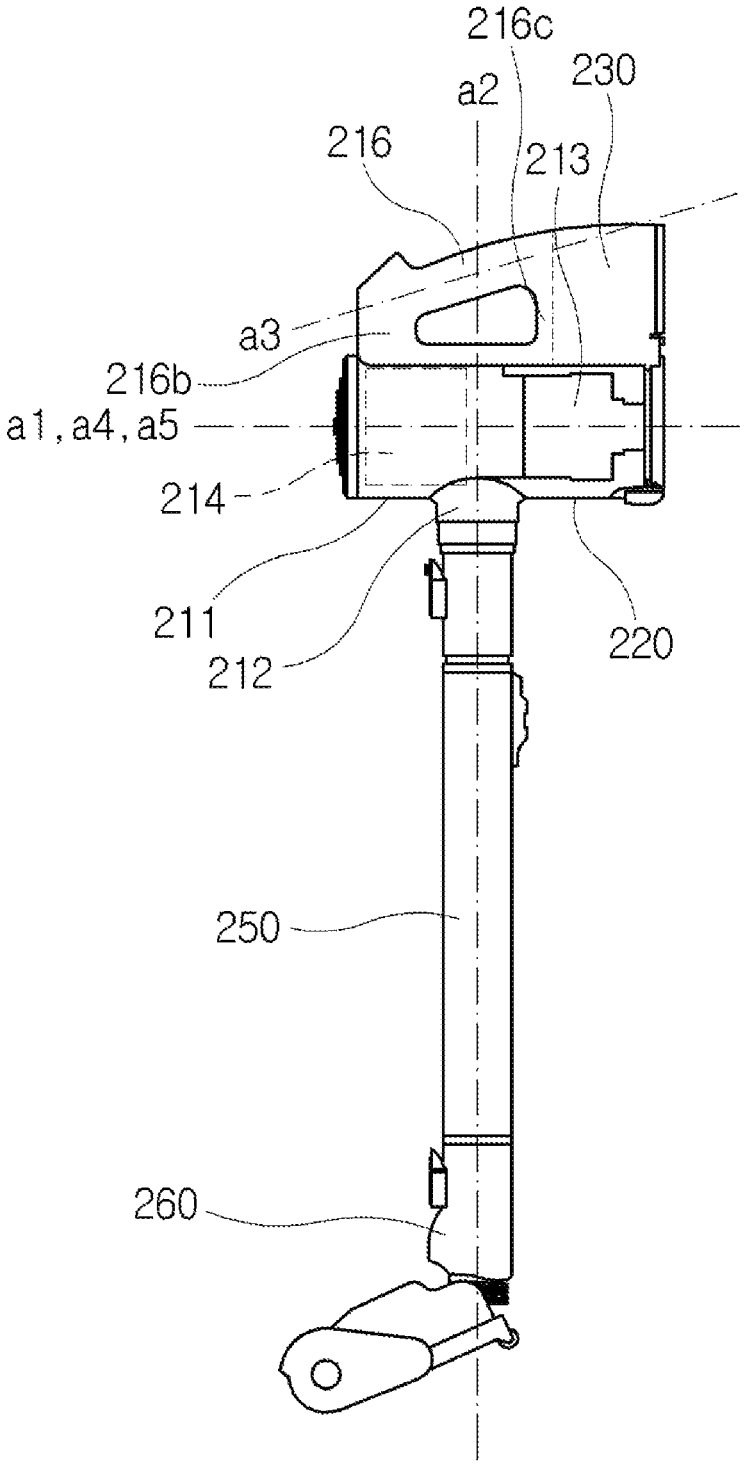
FIG. 3 is a view for explaining the cleaner in the cleaner system according to the embodiment of the present disclosure.
Figure 4:
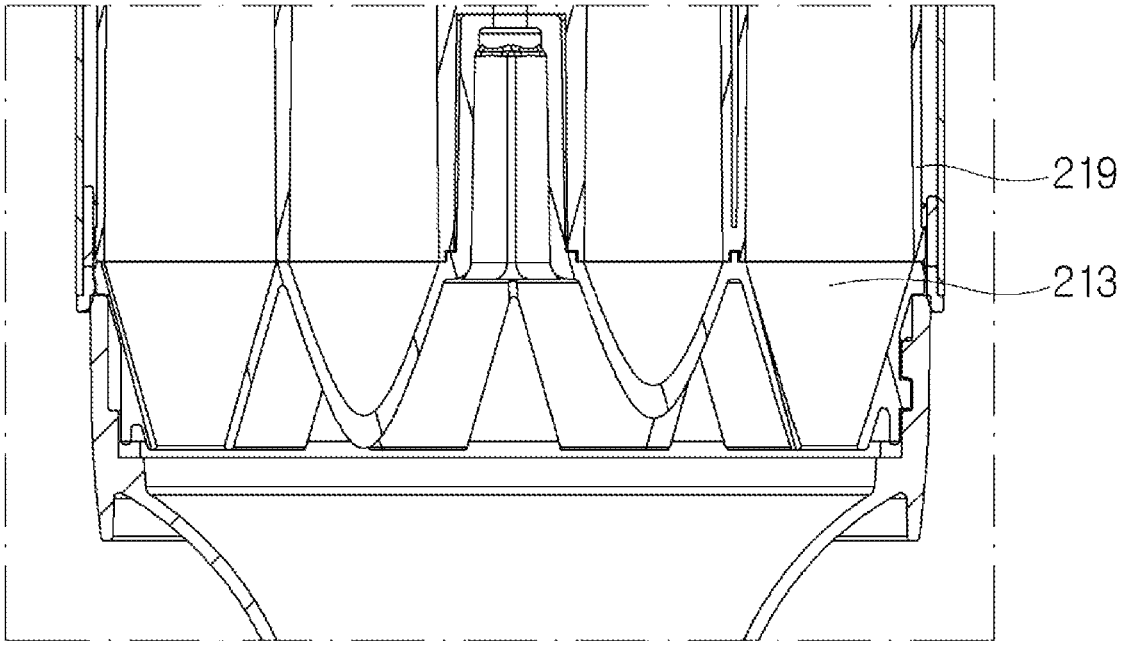
FIG. 4 is a view for explaining a dust separating part and a cyclone filter of a first cleaner according to the embodiment of the present disclosure.
Figure 5:
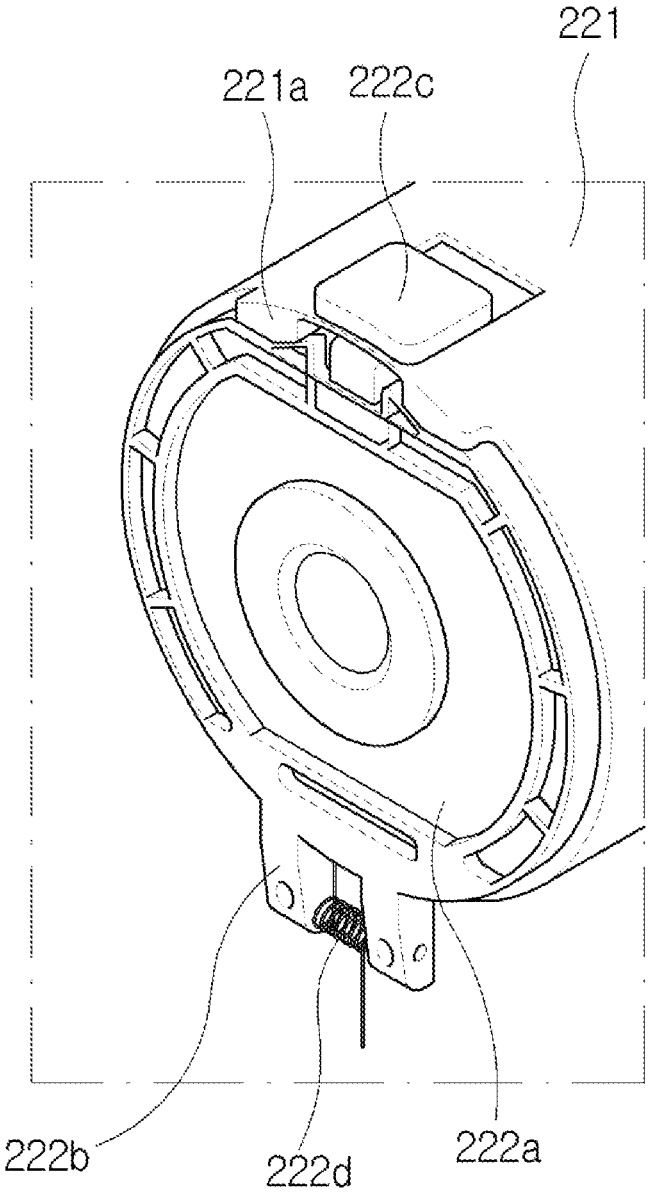
FIG. 5 is a view for explaining a lower side of a dust bin of the first cleaner according to the embodiment of the present disclosure.

Meanwhile, FIG. 3 is a view for explaining the cleaner 200 in the cleaner system according to the embodiment of the present disclosure, FIG. 4 is a view for explaining a dust separating part and a cyclone filter of the cleaner 200 according to the embodiment of the present disclosure, and FIG. 5 is a view for explaining a lower side of the dust bin of the cleaner 200 according to the embodiment of the present disclosure.

First, a structure of the cleaner 200 will be described below with reference to FIGS. 1 to 5.

The cleaner 200 may mean a cleaner configured to be manually operated by the user. For example, the cleaner 200 may mean a handy cleaner or a stick cleaner.

The cleaner 200 may be mounted on the cleaner station 100. The cleaner 200 may be supported by the cleaner station 100. The cleaner 200 may be coupled to the cleaner station 100.

Meanwhile, in the embodiment of the present disclosure, directions may be defined on the basis of when a bottom surface (lower surface) of the dust bin 220 and a bottom surface (lower surface) of a battery housing 230 are placed on the ground surface.

In this case, a forward direction may mean a direction in which a suction part 212 is disposed based on a suction motor 214, and a rearward direction may mean a direction in which a handle 216 is disposed. Further, on the basis of a state in which the suction part 212 is viewed from the suction motor 214, a rightward direction may refer to a direction in which a component is disposed at the right, and a left direction may refer to a direction in which a component is disposed at the left. In addition, in the embodiment of the present disclosure, upper and lower sides may be defined in a direction perpendicular to the ground surface based on the state in which the bottom surface (lower surface) of the dust bin 220 and the bottom surface (lower surface) of the battery housing 230 are placed on the ground surface.

The cleaner 200 may include a main body 210. The main body 210 may include a main body housing 211, the suction part 212, a dust separating part 213, the suction motor 214, an air discharge cover 215, the handle 216, and an operating part 218.

The main body housing 211 may define an external appearance of the cleaner 200. The main body housing 211 may provide a space that may accommodate the suction motor 214 and a filter (not illustrated) therein. The main body housing 211 may be formed in a shape similar to a cylindrical shape.

The suction part 212 may protrude outward from the main body housing 211. For example, the suction part 212 may be formed in a cylindrical shape with an opened inside. The suction part 212 may be coupled to an extension tube 250. The suction part 212 may provide a flow path (hereinafter, referred to as a 'suction flow path') through which air containing dust may flow.

Meanwhile, in the present embodiment, an imaginary line may be defined to penetrate the inside of the suction part 212 having a cylindrical shape. That is, an imaginary suction flow path through line a2 may be formed to penetrate the suction flow path in a longitudinal direction.

The dust separating part 213 may communicate with the suction part 212. The dust separating part 213 may separate dust sucked into the dust separating part 213 through the suction part 212. A space in the dust separating part 213 may communicate with a space in the dust bin 220.

For example, the dust separating part 213 may have two or more cyclone parts capable of separating dust using a cyclone flow. Further, the space in the dust separating part 213 may communicate with the suction flow path. Therefore, air and dust, which are sucked through the suction part 212, spirally flow along an inner circumferential surface of the dust separating part 213. Therefore, the cyclone flow may be generated in an internal space of the dust separating part 213.

The dust separating part 213 communicates with the suction part 212. The dust separating part 213 adopts a principle of a dust collector using a centrifugal force to separate the dust sucked into the main body 210 through the suction part 212.

For example, the dust separating part 213 may include at least one cyclone part capable of separating dust by using a cyclone flow. The cyclone part may communicate with the suction part 212. The air and dust introduced through the suction part 212 spirally flows along an inner peripheral surface of the cyclone part.

The dust separating part 213 may further include a secondary cyclone part configured to separate again dust from the air discharged from the cyclone part. In this case, the secondary cyclone part may be positioned in the cyclone part to minimize a size of the dust separating part. The secondary cyclone part may include a plurality of cyclone bodies disposed in parallel. The air discharged from the cyclone part may be distributed to and pass through the plurality of cyclone bodies.

In this case, an axis of a cyclone flow of the secondary cyclone part may also extend in an upward/downward direction. The axis of the cyclone flow of the cyclone part and the axis of the cyclone flow of the secondary cyclone part may be disposed coaxially in the upward/downward direction and collectively called an axis of the cyclone flow of the dust separating part 213. Meanwhile, in the present embodiment, an imaginary cyclone line a4 may be defined with respect to the axis of the cyclone flow.

The dust separating part 213 may further include a cyclone filter 219 disposed to surround the secondary cyclone part. For example, the cyclone filter 219 is formed in a cylindrical shape and guides the air, which is separated from dust in the cyclone part, to the secondary cyclone part. The cyclone filter 213*a* may filter out dust while the air pass through the cyclone filter.

To this end, the cyclone filter 219 may include a mesh portion having a plurality of holes. The mesh portion may be made of a metallic material. However, the present disclosure is not limited thereto.

The suction motor 214 may generate a suction force for sucking air. Air containing dust is introduced into the dust bin 220 by the suction force. The suction motor 214 may be accommodated in the main body housing 211. The suction motor 214 may generate the suction force while rotating. For example, the suction motor 214 may be formed in a shape similar to a cylindrical shape.

Meanwhile, in the present embodiment, an imaginary suction motor axis a1 may be formed by extending a rotation axis of the suction motor 214.

The air discharge cover 215 may be disposed at one side of the main body housing 211 based on an axial direction. The air discharge cover 215 may accommodate the filter for filtering air. For example, an HEPA filter may be accommodated in the air discharge cover 215.

The air discharge cover 215 may have an air discharge port 215*a* for discharging the air introduced by the suction force of the suction motor 214.

A flow guide may be disposed on the air discharge cover 215. The flow guide may guide a flow of the air to be discharged through the air discharge port 215*a*.

The handle 216 may be grasped by a user. The handle 216 may be disposed rearward of the suction motor 214. For example, the handle 216 may be formed in a shape similar to a cylindrical shape. Alternatively, the handle 216 may be formed in a curved cylindrical shape. The handle 216 may be disposed at a predetermined angle with respect to the main body housing 211, the suction motor 214, or the dust separating part 213.

The handle 216 may include a grip portion 216*a* formed in a column shape so that the user may grip the grip portion 216*a*, a first extension portion 216*b* connected to one end of the grip portion 216*a* based on the longitudinal direction (axial direction) and extending toward the suction motor 214, and a second extension portion 216*c* connected to the other end of the grip portion 216*a* based on the longitudinal direction (axial direction) and extending toward the dust bin 220.

Meanwhile, in the present embodiment, an imaginary grip portion through line a3 may be formed to extend in the longitudinal direction of the grip portion 216*a* (the axial direction of the column) and penetrate the grip portion 216*a*.

For example, the grip portion through line a3 may be an imaginary line formed in the handle 216 having a cylindrical shape, that is, an imaginary line formed in parallel with at least a part of an outer surface (outer circumferential surface) of the grip portion 216*a*.

An upper side of the handle 216 may define an external appearance of a part of an upper side of the cleaner 200. Therefore, it is possible to prevent a component of the cleaner 200 from coming into contact with the user's arm when the user grips the handle 216.

The first extension portion 216*b* may extend from the grip portion 216*a* toward the main body housing 211 or the suction motor 214. At least a part of the first extension portion 216*b* may extend in a horizontal direction.

The second extension portion 216*c* may extend from the grip portion 216*a* toward the dust bin 220. At least a part of the second extension portion 216*c* may extend in the horizontal direction.

The operating part 218 may be disposed on the handle 216. The operating part 218 may be disposed on an inclined surface formed in an upper region of the handle 216. The user may input a command for operating or stopping the cleaner 200 through the operating part 218.

The cleaner 200 may include the dust bin 220. The dust bin 220 may communicate with the dust separating part 213. The dust bin 220 may store the dust separated by the dust separating part 213.

The dust bin 220 may include a dust bin main body 221, a discharge cover 222, a dust bin compression lever 223, and a compression member (not illustrated).

The dust bin main body 221 may provide a space capable of storing the dust separated by the dust separating part 213. For example, the dust bin main body 221 may be formed in a shape similar to a cylindrical shape.

Meanwhile, in the present embodiment, an imaginary dust bin through line a5 may be formed to penetrate the inside (internal space) of the dust bin main body 221 and extend in the longitudinal direction of the dust bin main body 221 (that means the axial direction of the cylindrical dust bin main body 221).

Apart of a lower side (bottom side) of the dust bin main body 221 may be opened. In addition, a lower extension portion 221*a* may be formed at the lower side (bottom side) of the dust bin main body 221. The lower extension portion 221*a* may be formed to block a part of the lower side of the dust bin main body 221.

The dust bin 220 may include the discharge cover 222. The discharge cover 222 may be disposed at a lower side of the dust bin 220.

The discharge cover 222 may be provided to open or close one end of the dust bin main body 221 based on the longitudinal direction. Specifically, the discharge cover 222 may selectively open or close the lower side of the dust bin 220 that is opened downward.

A discharge port is formed at one side of the dust bin 220. The dust collected in the dust bin 220 may be discarded through the discharge port. The discharge port may be formed at the lower side of the dust bin 220.

The discharge cover 222 may include a cover main body 222*a* and a hinge part 222*b*. The cover main body 222*a* may be formed to block a part of the lower side of the dust bin main body 221. The cover main body 222*a* may be rotated downward about the hinge part 222*b*. The hinge part 222*b* may be disposed adjacent to the battery housing 230. For example, the hinge part 222*b* may include a torsion spring 222*d*. Therefore, when the discharge cover 222 is separated from the dust bin main body 221, an elastic force of the torsion spring 222*d* may support the cover main body 222*a* in a state in which the cover main body 222*a* is rotated by a predetermined angle or more about the hinge part 222*b* with respect to the dust bin main body 221.

The discharge cover 222 may be coupled to the dust bin 220 by a hook engagement. Meanwhile, the discharge cover 222 may be separated from the dust bin 220 by means of a coupling lever 222*c*. The coupling lever 222*c* may be disposed at a front side of the dust bin. Specifically, the coupling lever 222*c* may be disposed on an outer surface at the front side of the dust bin 220. When an external force is applied, the coupling lever 222*c* may elastically deform a hook, which extends from the cover main body 222*a*, in order to release the hook engagement between the cover main body 222*a* and the dust bin main body 221.

When the discharge cover 222 is closed, the lower side of the dust bin 220 may be blocked (sealed) by the discharge cover 222 and the lower extension portion 221*a*.

Figure 8:
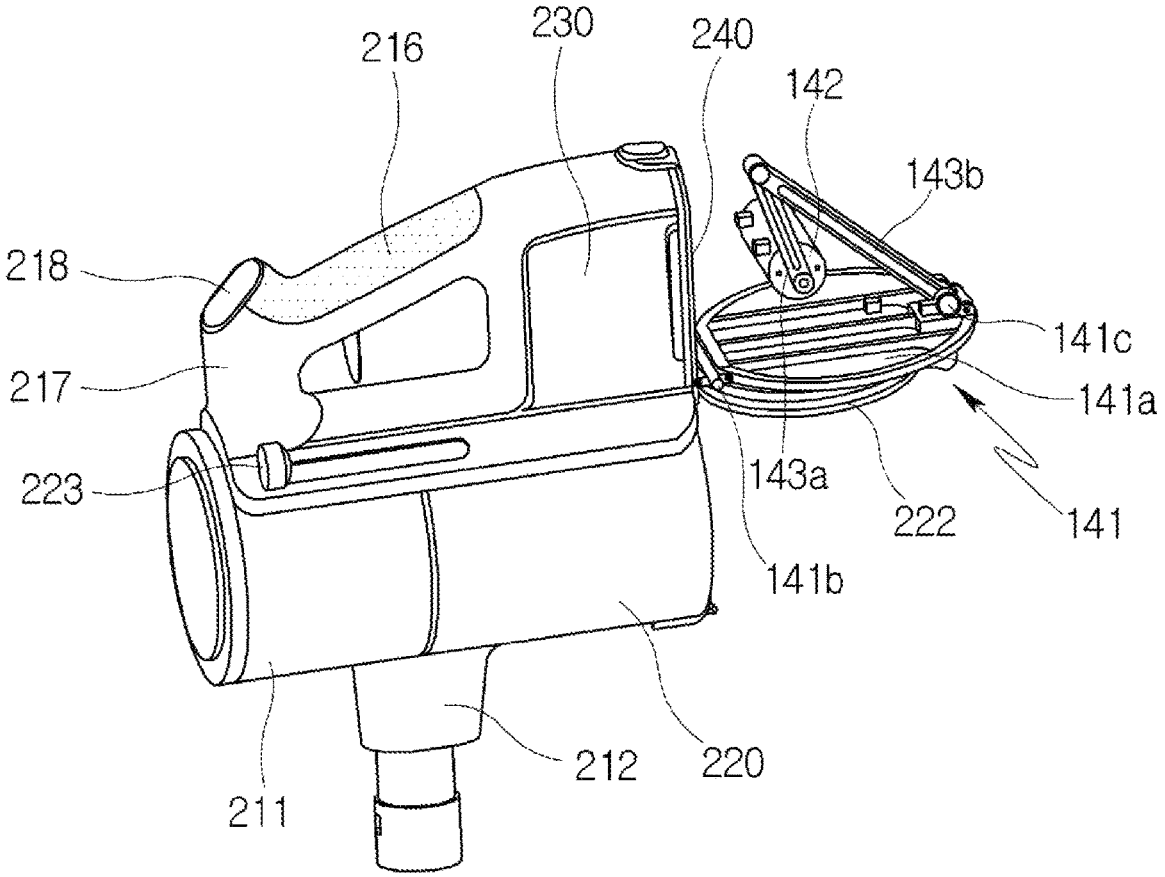
FIG. 8 is a view for explaining a relationship between the first cleaner and a door unit in the cleaner station according to the embodiment of the present disclosure.

The dust bin 220 may include the dust bin compression lever 223 (see FIG. 8). The dust bin compression lever 223 may be disposed outside the dust bin 220 or the dust separating part 211. The dust bin compression lever 223 may be disposed outside the dust bin 220 or the dust separating part 211 so as to be movable upward and downward. The dust bin compression lever 223 may be connected to the compression member (not illustrated). When the dust bin compression lever 223 is moved downward by an external force, the compression member (not illustrated) may also be moved downward. Therefore, it is possible to provide convenience for the user. The compression member (not illustrated) and the dust bin compression lever 223 may return back to original positions by an elastic member (not illustrated). Specifically, when the external force applied to the dust bin compression lever 223 is eliminated, the elastic member may move the dust bin compression lever 223 and the compression member (not illustrated) upward.

The compression member (not illustrated) may be disposed in the dust bin main body 221. The compression member may move in the internal space of the dust bin main body 221. Specifically, the compression member may move upward and downward in the dust bin main body 221. Therefore, the compression member may compress downward the dust in the dust bin main body 221. In addition, when the discharge cover 222 is separated from the dust bin main body 221 and thus the lower side of the dust bin 220 is opened, the compression member may move from an upper side of the dust bin 220 to the lower side of the of the dust bin 220, thereby removing debris such as residual dust in the dust bin 220. Therefore, it is possible to improve the suction force of the cleaner by preventing the residual dust from remaining in the dust bin 220. Further, it is possible to remove an offensive odor caused by the residual dust by preventing the residual dust from remaining in the dust bin 220.

The cleaner 200 may include the battery housing 230. A battery 240 may be accommodated in the battery housing 230. The battery housing 230 may be disposed below the handle 216. For example, the battery housing 230 may have a hexahedral shape opened at a lower side thereof. A rear side of the battery housing 230 may be connected to the handle 216.

The battery housing 230 may include an accommodation portion opened downward. The battery 240 may be attached or detached through the accommodation portion of the battery housing 220.

The cleaner 200 may include the battery 240.

For example, the battery 240 may be separably coupled to the cleaner 200. The battery 240 may be separably coupled to the battery housing 230. For example, the battery 240 may be inserted into the battery housing 230 from the lower side of the battery housing 230. With this configuration, the portability of the cleaner 200 may be improved.

On the contrary, the battery 240 may be integrally provided in the battery housing 230. In this case, a lower surface of the battery 240 is not exposed to the outside.

The battery 240 may supply power to the suction motor 214 of the cleaner 200. The battery 240 may be disposed on a lower portion of the handle 216. The battery 240 may be disposed at a rear side of the dust bin 220. That is, the suction motor 214 and the battery 240 may be disposed so as not to overlap each other in the upward/downward direction and disposed at different disposition heights. Based on the handle 216, the suction motor 214, which is heavy in weight, is disposed at a front side of the handle 216, and the battery 240, which is heavy in weight, is disposed at the lower side of the handle 216, such that an overall weight of the cleaner 200 may be uniformly distributed. Therefore, it is possible to prevent stress from being applied to the user's wrist when the user grasps the handle 216 and performs a cleaning operation.

In case that the battery 240 is coupled to the battery housing 230 in accordance with the embodiment, the lower surface of the battery 240 may be exposed to the outside. Because the battery 240 may be placed on the floor when the cleaner 200 is placed on the floor, the battery 240 may be immediately separated from the battery housing 230. In addition, because the lower side of the battery 240 is exposed to the outside and thus in direct contact with the air present outside the battery 240, the performance in cooling the battery 240 may be improved.

Meanwhile, in case that the battery 240 is fixed integrally to the battery housing 230, the number of structures for attaching or detaching the battery 240 and the battery housing 230 may be reduced, and as a result, it is possible to reduce an overall size of the cleaner 200 and a weight of the cleaner 200.

The cleaner 200 may include the extension tube 250. The extension tube 250 may communicate with a cleaning module 260. The extension tube 250 may communicate with the main body 210. The extension tube 250 may communicate with the suction part 214 of the main body 210. The extension tube 250 may be formed in a long cylindrical shape.

The main body 210 may be connected to the extension tube 250. The main body 210 may be connected to the cleaning module 260 through the extension tube 250. The main body 210 may generate the suction force by means of the suction motor 214 and provide the suction force to the cleaning module 260 through the extension tube 250. The outside dust may be introduced into the main body 210 through the cleaning module 260 and the extension tube 250.

The cleaner 200 may include the cleaning module 260. The cleaning module 260 may communicate with the extension tube 250. Therefore, the outside air may be introduced into the main body 210 of the cleaner 200 via the cleaning module 260 and the extension tube 250 by the suction force generated in the main body 210 of the cleaner 200.

The dust in the dust bin 220 of the cleaner 200 may be captured by a dust collecting part 170 of the cleaner station 100 by gravity and a suction force of a dust collecting motor 191. Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

The cleaner 200 may be coupled to a lateral surface of a housing 110. Specifically, the main body 210 of the cleaner 200 may be mounted on a coupling part 120. More specifically, the dust bin 220 and the battery housing 230 of the cleaner 200 may be coupled to a coupling surface 121, an outer circumferential surface of the dust bin main body 221 may be coupled to a dust bin guide surface 122, and the suction part 212 may be coupled to a suction part guide surface 126 of the coupling part 120. In this case, a central axis of the dust bin 220 may be disposed in a direction parallel to the ground surface, and the extension tube 250 may be disposed in a direction perpendicular to the ground surface (see FIG. 2).

The cleaner station 100 of the present disclosure will be described below with reference to FIGS. 1 and 2.

The cleaner 200 may be disposed in the cleaner station 100. Specifically, the cleaner 200 may be coupled to the lateral side of the cleaner station 100. The cleaner station 100 may remove dust from the dust bin 220 of the cleaner 200.

The cleaner station 100 may include the housing 110. The housing 110 may define an external appearance of the cleaner station 100. Specifically, the housing 110 may be provided in the form of a column including one or more outer wall surfaces. For example, the housing 110 may be formed in a shape similar to a quadrangular column.

The housing 110 may have an internal space capable of accommodating the dust collecting part 130 configured to store dust therein, and a dust suction module 170 configured to generate a flow force for collecting the dust in the dust collecting part 130. A flow path part 180 may be provided in the internal space.

The housing 110 may include a bottom surface 111, an outer wall surface 112, and an upper surface 113.

The bottom surface 111 may support a lower side of the dust suction module 170 based on the gravitational direction. That is, the bottom surface 111 may support a lower side of the dust collecting motor 171 of the dust suction module 170.

In this case, the bottom surface 111 may be disposed toward the ground surface. The bottom surface 111 may also be disposed in parallel with the ground surface or disposed to be inclined at a predetermined angle with respect to the ground surface. The above-mentioned configuration may be advantageous in stably supporting the dust collecting motor 171 and maintaining balance of an overall weight even in a case in which the cleaner 200 is coupled.

Meanwhile, according to the embodiment, the bottom surface 111 may further include ground surface support portions 111*a* in order to prevent the cleaner station 100 from falling down and increase an area being in contact with the ground surface to maintain the balance. For example, the ground surface support portion may have a plate shape extending from the bottom surface 111, and one or more frames may protrude and extend from the bottom surface 111 in a direction of the ground surface.

The outer wall surface 112 may mean a surface formed in the gravitational direction or a surface connected to the bottom surface 111. For example, the outer wall surface 112 may mean a surface connected to the bottom surface 111 so as to be perpendicular to the bottom surface 111. As another embodiment, the outer wall surface 112 may be disposed to be inclined at a predetermined angle with respect to the bottom surface 111.

The outer wall surface 112 may include at least one surface. For example, the outer wall surface 112 may include a first outer wall surface 112*a*, a second outer wall surface 112*b*, a third outer wall surface 112*c*, and a fourth outer wall surface 112*d*.

In this case, in the present embodiment, the first outer wall surface 112*a* may be disposed at the front side of the cleaner station 100. In this case, the front side may mean a side at which the cleaner 200 is exposed in the state in which the cleaner 200 is coupled to the cleaner station 100. Therefore, the first outer wall surface 112*a* may define an external appearance of the front side of the cleaner station 100.

Meanwhile, the directions are defined as follows to understand the present embodiment. In the present embodiment, the directions may be defined in the state in which the cleaner 200 is mounted on the cleaner station 100.

In the state in which the cleaner 200 is mounted on the cleaner station 100, a direction in which the cleaner 200 is exposed to the outside of the cleaner station 100 may be referred to as a forward direction.

In another point of view, in the state in which the cleaner 200 is mounted on the cleaner station 100, a direction in which the suction motor 214 of the cleaner 200 is disposed may be referred to as the forward direction. Further, a direction opposite to the direction in which the suction motor 214 is disposed on the cleaner station 100 may be referred to as a rearward direction.

In still another point of view, a direction in which an intersection point at which the grip portion through line a3 and the suction motor axis a1 intersect is disposed may be referred to as the forward direction based on the cleaner station 100. Alternatively, a direction in which an intersection point P2 at which the grip portion through line a3 and the suction flow path through line a2 intersect is disposed may be referred to as the forward direction. Alternatively, a direction in which an intersection point P1 at which the suction motor axis a1 and the suction flow path through line a2 intersect is disposed may be referred to as the forward direction. Further, a direction opposite to the direction in which the intersection point is disposed may be referred to as the rearward direction based on the cleaner station 100.

Further, based on the internal space of the housing 110, a surface facing the front surface may be referred to as a rear surface of the cleaner station 100. Therefore, the rear surface may mean a direction in which the second outer wall surface 112*b* is formed.

Further, based on the internal space of the housing 110, a left surface when viewing the front surface may be referred to as a left surface, and a right surface when viewing the front surface may be referred to as a right surface. Therefore, the left surface may mean a direction in which the third outer wall surface 112*c* is formed, and the right surface may mean a direction in which the fourth outer wall surface 112*d* is formed.

The first outer wall surface 112*a* may be formed in the form of a flat surface, or the first outer wall surface 112*a* may be formed in the form of a curved surface as a whole or formed to partially include a curved surface.

The first outer wall surface 112*a* may have an external appearance corresponding to the shape of the cleaner 200. In detail, the coupling part 120 may be disposed on the first outer wall surface 112*a*. With this configuration, the cleaner 200 may be coupled to the cleaner station 100 and supported by the cleaner station 100. The specific configuration of the coupling part 120 will be described below.

Meanwhile, a structure for mounting various types of cleaning modules 290 used for the cleaner 200 may be additionally provided on the first outer wall surface 112*a*.

In the present embodiment, the second outer wall surface 112*b* may be a surface facing the first outer wall surface 112*a*. That is, the second outer wall surface 112*b* may be disposed on the rear surface of the cleaner station 100. In this case, the rear surface may be a surface facing the surface to which the cleaner 200 is coupled. Therefore, the second outer wall surface 112*b* may define an external appearance of the rear surface of the cleaner station 100.

For example, the second outer wall surface 112*b* may be formed in the form of a flat surface. With this configuration, the cleaner station 100 may be in close contact with a wall in a room, and the cleaner station 100 may be stably supported.

As another example, the structure for mounting various types of cleaning modules 290 used for the cleaner 200 may be additionally provided on the second outer wall surface 112*b*.

In the present embodiment, the third outer wall surface 112*c* and the fourth outer wall surface 112*d* may mean surfaces that connect the first outer wall surface 112*a* and the second outer wall surface 112*b*. In this case, the third outer wall surface 112*c* may be disposed on the left surface of the station 100, and the fourth outer wall surface 112*d* may be disposed on the right surface of the cleaner station 100. Otherwise, the third outer wall surface 112*c* may be disposed on the right surface of the cleaner station 100, and the fourth outer wall surface 112*d* may be disposed on the left surface of the cleaner station 100.

The third outer wall surface 112*c* or the fourth outer wall surface 112*d* may be formed in the form of a flat surface, or the third outer wall surface 112*c* or the fourth outer wall surface 112*d* may be formed in the form of a curved surface as a whole or formed to partially include a curved surface.

Meanwhile, the structure for mounting various types of cleaning modules 290 used for the cleaner 200 may be additionally provided on the third outer wall surface 112*c* or the fourth outer wall surface 112*d*.

The upper surface 113 may define an upper external appearance of the cleaner station. That is, the upper surface 113 may mean a surface disposed at an outermost side of the cleaner station in the gravitational direction and exposed to the outside.

For reference, in the present embodiment, the terms 'upper side' and 'lower side' may mean the upper and lower sides in the gravitational direction (a direction perpendicular to the ground surface) in the state in which the cleaner station 100 is installed on the ground surface.

In this case, the upper surface 113 may also be disposed in parallel with the ground surface or disposed to be inclined at a predetermined angle with respect to the ground surface.

A display part 410 may be disposed on the upper surface 113. For example, the display part 410 may display a state of the cleaner station 100 and a state of the cleaner 200. The display part may further display information such as a cleaning process situation, a map of the cleaning zone, and the like.

Meanwhile, according to the embodiment, the upper surface 113 may be separable from the outer wall surface 112. In this case, when the upper surface 113 is separated, the battery separated from the cleaner 200 or 300 may be accommodated in the internal space surrounded by the outer wall surface 112, and a terminal (not illustrated) capable of charging the separated battery may be provided in the internal space.

Figure 6:
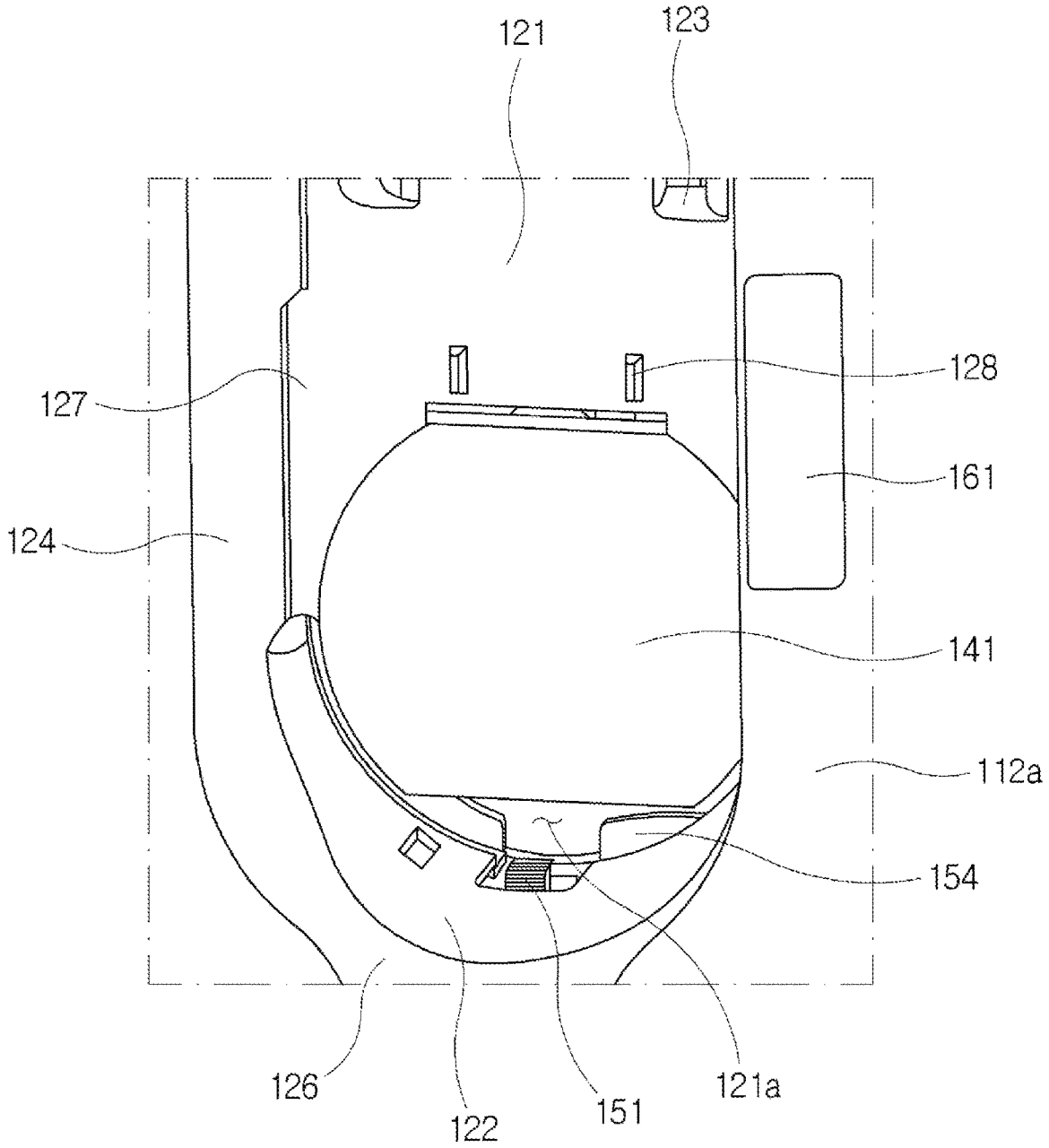
FIG. 6 is a view for explaining a coupling part of the cleaner station according to the embodiment of the present disclosure.
Figure 7:
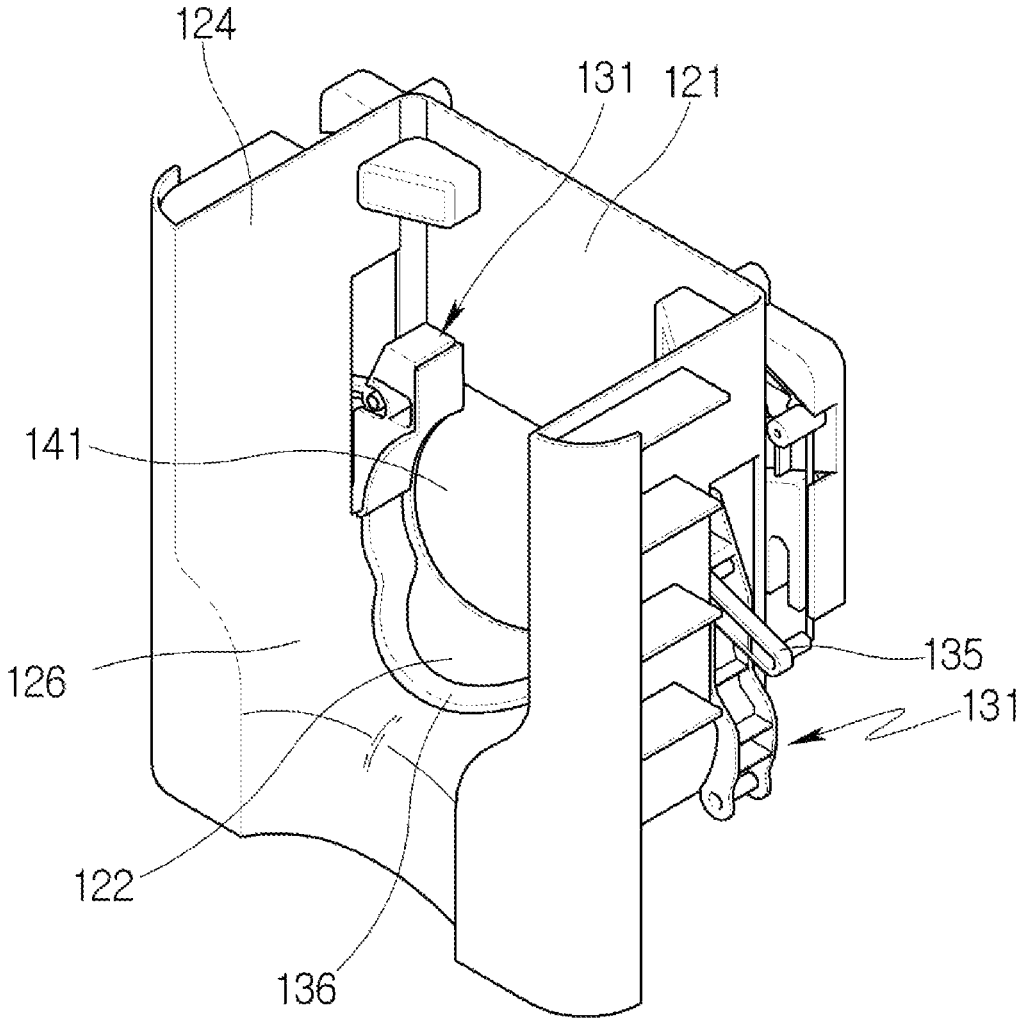
FIG. 7 is an exploded perspective view for explaining a fixing unit of the cleaner station according to the embodiment of the present disclosure.
Figure 9:
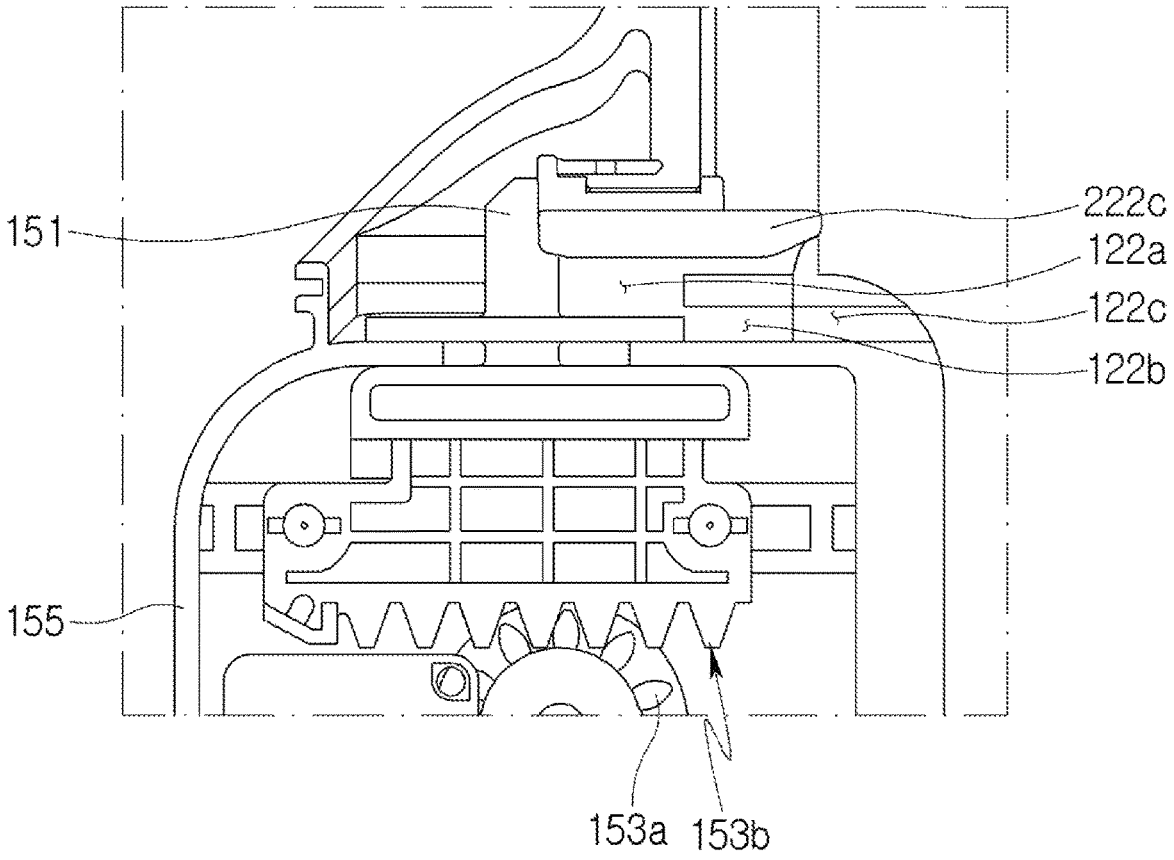
FIG. 9 is a view for explaining a relationship between the first cleaner and a cover opening unit in the cleaner station according to the embodiment of the present disclosure.

FIG. 6 is a view for explaining the coupling part 120 of the cleaner station 100 according to the embodiment of the present disclosure, FIG. 7 is an exploded perspective view for explaining a fixing unit 130 of the cleaner station 100 according to the embodiment of the present disclosure, FIG. 8 is a view for explaining a relationship between the cleaner 200 and a door unit 140 in the cleaner station 100 according to the embodiment of the present disclosure, and FIG. 9 is a view for explaining a relationship between the cleaner 200 and a cover opening unit 150 in the cleaner station 100 according to the embodiment of the present disclosure.

The coupling part 120 of the cleaner station 100 according to the present disclosure will be described below with reference to FIGS. 2 and 6.

The cleaner station 100 may include the coupling part 120 to which the cleaner 200 is coupled. Specifically, the coupling part 120 may be disposed in the first outer wall surface 112*a*, and the main body 210, the dust bin 220, and the battery housing 230 of the cleaner 200 may be coupled to the coupling part 120.

The coupling part 120 is disposed in the housing 110 and includes a coupling surface 121 to which at least a part of the cleaner 200 is coupled.

The coupling part 120 may include the coupling surface 121. The coupling surface 121 may be disposed on the lateral surface of the housing 110. For example, the coupling surface 121 may mean a surface formed in the form of a groove which is concave toward the inside of the cleaner station 100 from the first outer wall surface 112*a*. That is, the coupling surface 121 may mean a surface formed to have a stepped portion with respect to the first outer wall surface 112*a*.

The cleaner 200 may be coupled to the coupling surface 121. For example, the coupling surface 121 may be in contact with the lower surface of the dust bin 220 and the lower surface of the battery housing 230 of the cleaner 200. In this case, the lower surface may mean a surface directed toward the ground surface when the user uses the cleaner 200 or places the cleaner 200 on the ground surface.

For example, an angle of the coupling surface 121 with respect to the ground surface may be a right angle. Therefore, it is possible to minimize a space of the cleaner station 100 when the cleaner 200 is coupled to the coupling surface 121.

As another example, the coupling surface 121 may be disposed to be inclined at a predetermined angle with respect to the ground surface. Therefore, the cleaner station 100 may be stably supported when the cleaner 200 is coupled to the coupling surface 121.

The coupling surface 121 may have a dust passage hole 121*a* through which air present outside the housing 110 may be introduced into the housing 110. The dust passage hole 121*a* may be formed in the form of a hole corresponding to the shape of the dust bin 220 so that the dust in the dust bin 220 may be introduced into the dust collecting part 170. The dust passage hole 121*a* may be formed to correspond to the shape of the discharge cover 222 of the dust bin 220. The dust passage hole 121*a* may be formed to communicate with the flow path 180 to be described below.

The coupling part 120 may include the dust bin guide surface 122. The dust bin guide surface 122 may be disposed on the first outer wall surface 112*a*. The dust bin guide surface 122 may be connected to the first outer wall surface 112*a*. In addition, the dust bin guide surface 122 may be connected to the coupling surface 121.

The dust bin guide surface 122 may be formed in a shape corresponding to the outer surface of the dust bin 220. A front outer surface of the dust bin 220 may be coupled to the dust bin guide surface 122. Therefore, it is possible to provide the convenience when coupling the cleaner 200 to the coupling surface 121.

Meanwhile, a protrusion moving hole 122*a* may be formed in the dust bin guide surface 122, and a push protrusion 151 to be described below may rectilinearly move along the protrusion moving hole 122*a*. In addition, a gearbox 155 may be provided below the dust bin guide surface 122 based on the gravitational direction and accommodate a gear or the like of a cover opening unit 150 to be described below. In this case, a guide space 122*b*, through which the push protrusion 151 may move, may be formed between the dust bin guide surface 122, the lower surface, and the upper surface of the gearbox 155. Further, the guide space 122*b* may communicate with a first flow path 180*a* through a bypass hole 122*c*. That is, the protrusion moving hole 122*a*, the guide space 122*b*, the bypass hole 122*c*, and the first flow path 180*a* may define one bypass flow path (see FIG. 9). With this configuration, when the dust collecting motor 191 operates in the state in which the dust bin 220 is coupled to the coupling part 120, the dust or the like, which remains in the dust bin 220 and remains on the dust bin guide surface 122, may be sucked through the bypass flow path.

The coupling part 120 may include guide protrusions 123. The guide protrusions 123 may be disposed on the coupling surface 121. The guide protrusions 123 may protrude upward from the coupling surface 121. Two guide protrusions 123 may be disposed to be spaced apart from each other. A distance between the two guide protrusions 123, which are spaced apart from each other, may correspond to a width of the battery housing 230 of the cleaner 200. Therefore, it is possible to provide the convenience when coupling the cleaner 200 to the coupling surface 121.

The coupling part 120 may include sidewalls 124. The sidewalls 124 may mean wall surfaces disposed at two opposite sides of the coupling surface 121 and may be perpendicularly connected to the coupling surface 121. The sidewalls 124 may be connected to the first outer wall surface 112*a*. In addition, the sidewalls 124 may define surfaces connected to the dust bin guide surface 122. Therefore, the cleaner 200 may be stably accommodated.

The coupling part 120 may include a coupling sensor 125. The coupling sensor 125 may detect whether the cleaner 200 is coupled to the coupling part 120.

The coupling sensor 125 may include a contact sensor. For example, the coupling sensor 125 may include a microswitch. In this case, the coupling sensor 125 may be disposed on the guide protrusion 123. Therefore, when the battery housing 230 or the battery 240 of the cleaner 200 is coupled between the pair of guide protrusions 123, the battery housing 230 or the battery 240 comes into contact with the coupling sensor 125, such that the coupling sensor 125 may detect that the cleaner 200 is coupled to the coupling part.

Meanwhile, the coupling sensor 125 may include a contactless sensor. For example, the coupling sensor 125 may include an infrared ray (IR) sensor. In this case, the coupling sensor 125 may be disposed on the sidewall 124. Therefore, when the dust bin 220 or the main body 210 of the cleaner 200 passes the sidewall 124 and then reaches the coupling surface 121, the coupling sensor 125 may detect the presence of the dust bin 220 or the main body 210.

The coupling sensor 125 may face the dust bin 220 or the battery housing 230 of the cleaner 200.

The coupling sensor 125 may be a mean for determining whether the cleaner 200 is coupled and power is applied to the battery 240 of the cleaner 200.

The coupling part 120 may include the suction part guide surface 126. The suction part guide surface 126 may be disposed on the first outer wall surface 112*a*. The suction part guide surface 126 may be connected to the dust bin guide surface 122. The suction part 212 may be coupled to the suction part guide surface 126. The suction part guide surface 126 may be formed in a shape corresponding to the shape of the suction part 212.

The coupling part 120 may further include fixing member entrance holes 127. The fixing member entrance hole 127 may be formed in the form of a long hole along the sidewall 124 so that fixing members 131 may enter and exit the fixing member entrance hole 127.

With this configuration, when the user couples the cleaner 200 to the coupling part 120 of the cleaner station 100, the main body 210 of the cleaner 200 may be stably disposed on the coupling part 120 by the dust bin guide surface 122, the guide protrusions 123, and the suction part guide surface 126. Therefore, it is possible to provide convenience when coupling the dust bin 220 and the battery housing 230 of the cleaner 200 to the coupling surface 121.

The fixing unit 130 according to the present disclosure will be described below with reference to FIGS. 2 and 7.

The cleaner station 100 according to the present disclosure may include the fixing unit 130. The fixing unit 130 may be disposed on the sidewall 124. In addition, the fixing unit 130 may be disposed on a back surface to the coupling surface 121. The fixing unit 130 may fix the cleaner 200 coupled to the coupling surface 121. Specifically, the fixing unit 130 may fix the dust bin 220 and the battery housing 230 of the cleaner 200 coupled to the coupling surface 121.

The fixing unit 130 may include a fixing members 131 configured to fix the dust bin 220 and the battery housing 230 of the cleaner 200, and a fixing part motor 133 configured to operate the fixing members 131. In addition, the fixing unit 130 may further include fixing part links 135 configured to transmit power of the fixing part motor 133 to the fixing members 131.

The fixing members 131 may be disposed on the sidewall 124 of the coupling part 120 and provided on the sidewall 124 so as to reciprocate in order to fix the dust bin 220. Specifically, the fixing members 131 may be accommodated in the fixing member entrance holes 127.

The fixing members 131 may be disposed at two opposite sides of the coupling part 120, respectively. For example, a pair of two fixing members 131 may be symmetrically disposed with respect to the coupling surface 121.

The fixing part motor 133 may provide power for moving the fixing member 131.

The fixing part links 135 may convert a rotational force of the fixing part motor 133 into the reciprocations of the fixing members 131.

A stationary sealer 136 may be disposed on the dust bin guide surface 122 so as to seal the dust bin 220 when the cleaner 200 is coupled. With this configuration, when the dust bin 220 of the cleaner 200 is coupled, the cleaner 200 may press the stationary sealer 136 by its own weight, such that the dust bin 220 and the dust bin guide surface 122 may be sealed.

The stationary sealer 136 may be disposed on an imaginary extension line of the fixing member 131. With this configuration, when the fixing part motor 133 operates and the fixing members 131 press the dust bin 220, a circumference of the dust bin 220 at the same height may be sealed.

According to the embodiment, the stationary sealer 136 may be disposed on the dust bin guide surface 122 and formed in the form of a bent line corresponding to an arrangement of the cover opening unit 150 to be described below.

Therefore, when the main body 210 of the cleaner 200 is disposed on the coupling part 120, the fixing unit 130 may fix the main body 210 of the cleaner 200. Specifically, when the coupling sensor 125 detects that the main body 210 of the cleaner 200 is coupled to the coupling part 120 of the cleaner station 100, the fixing part motor 133 may move the fixing members 131 to fix the main body 210 of the cleaner 200.

Therefore, it is possible to improve the suction force of the cleaner by preventing the residual dust from remaining in the dust bin. Further, it is possible to remove an offensive odor caused by the residual dust by preventing the residual dust from remaining in the dust bin.

The door unit 140 according to the present disclosure will be described below with reference to FIGS. 2 and 8.

The cleaner station 100 according to the present disclosure may include the door unit 140. The door unit 140 may be configured to open or close the dust passage hole 121*a*.

The door unit 140 may include a door 141, a door motor 142, and a door arm 143.

The door 141 may be hingedly coupled to the coupling surface 121 and may open or close the dust passage hole 121*a*. The door 141 may include a door main body 141*a*, a hinge part 141*b*, and an arm coupling part 141*c*.

The door main body 141*a* may be formed in a shape capable of blocking the dust passage hole 121*a*. For example, the door main body 141*a* may be formed in a shape similar to a circular plate shape. On the basis of a state in which the door main body 141*a* blocks the dust passage hole 121*a*, the hinge part 141*b* may be disposed at an upper side of the door main body 141*a*, and the arm coupling part 141*c* may be disposed at a lower side of the door main body 141*a*.

The door main body 141*a* may be formed in a shape capable of sealing the dust passage hole 121*a*. For example, an outer surface of the door main body 141*a*, which is exposed to the outside of the cleaner station 100, is formed to have a diameter corresponding to a diameter of the dust passage hole 121*a*, and an inner surface of the door main body 141*a*, which is disposed in the cleaner station 100, is formed to have a diameter greater than the diameter of the dust passage hole 121*a*. In addition, a level difference may be defined between the outer surface and the inner surface. Meanwhile, one or more reinforcing ribs may protrude from the inner surface in order to connect the hinge part 141*b* and the arm coupling part 141*c* and reinforce a supporting force of the door main body 141*a*.

The hinge part 141*b* may be a means by which the door 141 is hingedly coupled to the coupling surface 121. The hinge part 141*b* may be disposed at an upper end of the door main body 141*a* and coupled to the coupling surface 121.

The arm coupling part 141*c* may be a means to which the door arm 143 is rotatably coupled. The arm coupling part 141*c* may be disposed at a lower side of the inner surface, and the door arm 143 may be rotatably coupled to the arm coupling part 141*c*.

With this configuration, when the door arm 143 pulls the door main body 141*a* in the state in which the door 141 closes the dust passage hole 121*a*, the door main body 141*a* is rotated about the hinge part 141*b* toward the inside of the cleaner station 100, such that the dust passage hole 121*a* may be opened. Meanwhile, when the door arm 143 pushes the door main body 141*a* in the state in which the dust passage hole 121*a* is opened, the door main body 141*a* is rotated about the hinge part 141*b* toward the outside of the cleaner station 100, such that the dust passage hole 121*a* may be closed.

The door motor 142 may provide power for rotating the door 141. Specifically, the door motor 142 may rotate the door arm 143 in a forward or reverse direction. In this case, the forward direction may mean a direction in which the door arm 143 pulls the door 141. Therefore, when the door arm 143 is rotated in the forward direction, the dust passage hole 121*a* may be opened. In addition, the reverse direction may mean a direction in which the door arm 143 pushes the door 141. Therefore, when the door arm 143 is rotated in the reverse direction, at least a part of the dust passage hole 121*a* may be closed. The forward direction may be opposite to the reverse direction.

The door arm 143 may connect the door 141 and the door motor 142 and open or close the door 141 using the power generated from the door motor 142.

For example, the door arm 143 may include a first door arm 143*a* and the second door arm 143*b*. One end of the first door arm 143*a* may be coupled to the door motor 142. The first door arm 143*a* may be rotated by the power of the door motor 142. The other end of the first door arm 143*a* may be rotatably coupled to the second door arm 143*b*. The first door arm 143*a* may transmit a force transmitted from the door motor 142 to the second door arm 143*b*. One end of the second door arm 143*b* may be coupled to the first door arm 143*a*. The other end of the second door arm 143*b* may be coupled to the door 141. The second door arm 143*b* may open or close the dust passage hole 121*a* by pushing or pulling the door 141.

The door unit 140 may further include door opening/closing detecting parts 144. The door opening/closing detecting parts 144 may be provided in the housing 100 and may detect whether the door 141 is in an opened state.

For example, the door opening/closing detecting parts 144 may be disposed at both ends in a rotational region of the door arm 143, respectively. As another example, the door opening/closing detecting parts 144 may be disposed at both ends in a movement region of the door 141, respectively.

Therefore, when the door arm 143 is moved to a preset door opening position DP1 or when the door 141 is opened to a predetermined position, the door opening/closing detecting parts 144 may detect that the door is opened. In addition, when the door arm 143 is moved to a preset door closing position DP2 or when the door 141 is opened to a predetermined position, the door opening/closing detecting parts 144 may detect that the door is opened. In addition, in the present embodiment, when the door arm 143 is moved to a preset door flow velocity control position DP3 or when the door 141 is rotated to a predetermined position, the door opening/closing detecting parts 144 may detect that the door reaches a position at which the dust collecting motor 191 may change a flow velocity of air to be introduced.

The door opening/closing detecting part 144 may include a contact sensor. For example, the door opening/closing detecting part 144 may include a micro-switch.

Meanwhile, the door opening/closing detecting part 144 may also include a contactless sensor. For example, the door opening/closing detecting part 144 may include an infrared ray (IR) sensor.

With this configuration, the door unit 140 may selectively open or close at least a part of the coupling surface 121, thereby allowing the outside of the first outer wall surface 112*a* to communicate with the flow path part 180 and/or the dust collecting part 170.

The door unit 140 may be opened when the discharge cover 222 of the cleaner 200 is opened. In addition, when the door unit 140 is closed, the discharge cover 222 of the cleaner 200 may also be closed.

When the dust in the dust bin 220 of the cleaner 200 is removed, the door motor 142 may rotate the door 141, thereby coupling the discharge cover 222 to the dust bin main body 221. Specifically, the door motor 142 may rotate the door 141 to rotate the door 142 about the hinge part 141*b*, and the door 142 rotated about the hinge part 141*b* may push the discharge cover 222 toward the dust bin main body 221.

The cover opening unit 150 according to the present disclosure will be described below with reference to FIGS. 2 and 9.

The cleaner station 100 according to the present disclosure may include the cover opening unit 150. The cover opening unit 150 may be disposed on the coupling part 120 and may open the discharge cover 222 of the cleaner 200.

The cover opening unit 150 may include the push protrusion 151, a cover opening motor 152, cover opening gears 153, a support plate 154, and the gear box 155.

The push protrusion 151 may move to press the coupling lever 222*c* when the cleaner 200 is coupled.

The push protrusion 151 may be disposed on the dust bin guide surface 122. Specifically, the protrusion moving hole may be formed in the dust bin guide surface 122, and the push protrusion 151 may be exposed to the outside by passing through the protrusion moving hole.

When the cleaner 100 is coupled, the push protrusion 151 may be disposed at a position at which the push protrusion 151 may push the coupling lever 222*c*. That is, the coupling lever 222*c* may be disposed on the protrusion moving hole. In addition, the coupling lever 222*c* may be disposed in a movement region of the push protrusion 151.

The push protrusion 151 may rectilinearly reciprocate to press the coupling lever 222*c*. Specifically, the push protrusion 151 may be coupled to the gear box 155, such that the rectilinear movement of the push protrusion 151 may be guided. The push protrusion 151 may be coupled to the cover opening gears 153 and moved together with the cover opening gears 153 by the movements of the cover opening gears 153.

The cover opening motor 152 may provide power for moving the push protrusion 151. Specifically, the cover opening motor 152 may rotate a motor shaft (not illustrated) in a forward direction or a reverse direction. In this case, the forward direction may mean a direction in which the push protrusion 151 pushes the coupling lever 222*c*. In addition, the reverse direction may mean a direction in which the push protrusion 151, which has pushed the coupling lever 222*c*, returns back to an original position. The forward direction may be opposite to the reverse direction.

The cover opening gears 153 may be coupled to the cover opening motor 152 and may move the push protrusion 151 using the power from the cover opening motor 152. Specifically, the cover opening gears 153 may be accommodated in the gear box 155. A driving gear 153*a* of the cover opening gears 153 may be coupled to the motor shaft of the cover opening motor 152 and supplied with the power. A driven gear 153*b* of the cover opening gears 153 may be coupled to the push protrusion 151 to move the push protrusion 151. For example, the driven gear 153*b* may be provided in the form of a rack gear, engage with the driving gear 153*a*, and receive power from the driving gear 153*a*.

In this case, the discharge cover 222 may have the torsion spring 222*d*. The discharge cover 222 may be rotated by a predetermined angle or more and supported in the rotated position by an elastic force of the torsion spring 222*d*. Therefore, the discharge cover 222 may be opened, and the dust passage hole 121*a* and the inside of the dust bin 220 may communicate with each other.

The gear box 155 may be disposed in the housing 110 and disposed at the lower side of the coupling part 120 in the gravitational direction, and the cover opening gears 153 may be accommodated in the gear box 155.

Cover opening detecting parts 155*f* may be disposed on the gear box 155. In this case, the cover opening detecting part 155*f* may include a contact sensor. For example, the cover opening detecting part 155*f* may include a micro-switch. Meanwhile, the cover opening detecting part 155*f* may also include a contactless sensor. For example, the cover opening detecting part 155*f* may include an infrared (IR) sensor.

The cover opening detecting part 155*f* may be disposed on at least one of inner and outer walls of the gear box 155. For example, the single cover opening detecting part 155*f* may be disposed on the inner surface of the gear box 155. In this case, the cover opening detecting part 155*f* may detect that the push protrusion 151 is positioned at the initial position.

As another example, the two cover opening detecting parts 155*f* may be disposed on the outer surface of the gear box 155. In this case, the cover opening detecting part 155*f* may detect the initial position and the cover opening position of the push protrusion 151.

Accordingly, according to the present disclosure, the cover opening unit 150 may open the dust bin 220 even though the user separately opens the discharge cover 222 of the cleaner, and as a result, it is possible to improve convenience.

In addition, since the discharge cover 222 is opened in the state in which the cleaner 200 is coupled to the cleaner station 100, it is possible to prevent the dust from scattering.

Meanwhile, the dust collecting part 170 will be described below with reference to FIGS. 2 and 10.

The cleaner station 100 may include the dust collecting part 170. The dust collecting part 170 may be disposed in the housing 110. The dust collecting part 170 may be disposed at a lower side in the gravitational direction of the coupling part 120.

The dust collecting part 170 is accommodated in the housing 110 and disposed at the lower side of the coupling part 120. The dust collecting part 170 captures the dust in the dust bin 220 of the cleaner 200.

For example, the dust collecting part 170 may mean a dust bag for collecting dust sucked from the inside of the dust bin 220 of the cleaner 200 by the dust collecting motor 191.

The dust collecting part 170 may be detachably coupled to the housing 110.

Therefore, the dust collecting part 170 may be separated from the housing 110 and discarded, a new dust collecting part 170 may be coupled to the housing 110. That is, the dust collecting part 170 may be defined as a consumable component.

When the suction force is generated by the dust collecting motor 200, a volume of the dust bag is increased, such that the dust may be accommodated in the dust bag. To this end, the dust bag may be made of a material that transmits air but does not transmit debris such as dust. For example, the dust bag may be made of a non-woven fabric material and have a hexahedral shape when the dust bag has an increased volume.

Therefore, it is not necessary for the user to separately tie a bag in which the dust is captured, and as a result, it is possible to improve convenience for the user.

Meanwhile, the cleaner station 100 according to the embodiment of the present disclosure may further include a sterilization module 175.

At least one sterilization module 175 may be provided on the flow path part 180 or provided at the periphery of the dust collecting part 170.

The sterilization module 175 is configured to sterilize the dust captured in the dust collecting part 170. The sterilization module 175 may include a light source configured to emit sterilization light, and a protection panel disposed below the light source and configured to protect the light source.

In this case, the light source may include one or more light-emitting diodes (LEDs) capable of emitting the sterilization light having sterilizing power for removing bacteria. The sterilization light emitted from the light source may have a wavelength that varies depending on types of light-emitting diodes.

For example, the light source may be a light-emitting diode that emits ultraviolet rays within UV-C wavelength ranges. The ultraviolet rays are divided into UV-A rays (315 nm to 400 nm), UV-B rays (280 nm to 315 nm), and UV-C rays (200 nm to 280 nm) based on the wavelengths. The ultraviolet ray in the UV-C region may inhibit the proliferation of microorganisms by damaging DNA double helices of the microorganisms.

Alternatively, as another example, the light source may be a light-emitting diode that emits visible light with a wavelength of 405 nm. The blue light having a wavelength of 405 nm has a wavelength in a boundary region between the visible ray and the ultraviolet ray and has proved sterilizing power.

In order to prevent damage to the light source, the protection panel may be disposed below the light source and spaced apart from the light source at a predetermined distance. In this case, the protection panel may be made of a material that maximize the transmittance of the light source. For example, the protection panel may be made of quartz. It is known that the quartz does not hinder the transmission of the ultraviolet rays in the UV-C region.

The cleaner station 100 according to the embodiment of the present disclosure has the sterilization module 175 that sterilizes the dust collecting part 170 to prevent bacteria from proliferating in the dust collecting part 170, thereby hygienically managing the dust collecting part 170 that stores the sucked dust for a long period of time.

Meanwhile, the flow path part 180 will be described below with reference to FIGS. 2 and 10.

The cleaner station 100 may include the flow path part 180. The flow path part 180 may connect the cleaner 200 and the dust collecting part 170.

The flow path part 180 is formed so that the dust in the dust bin 220 may flow through the flow path part 180. The flow path part 180 is accommodated in the internal space of the housing 110.

The flow path part 180 may be disposed at a rear side of the coupling surface 121. The flow path part 180 may mean a space between the dust bin 220 of the cleaner 200 and the dust collecting part 170. The flow path part 180 may be a space formed at a rear side of the dust passage hole 121*a*. The flow path part 180 may be a flow path bent downward from the dust passage hole 121*a*, and the dust and the air may flow through the flow path part 180.

Specifically, the flow path part 180 may include the first flow path 180*a* and a second flow path 180*b*. When the cleaner 200 is coupled to the cleaner station 200 and the dust passage hole 121*a* is opened, the first flow path 180*a* communicates with the internal space of the dust bin 220, and the second flow path 181*b* allows the first flow path 181*a* to communicate with the internal space of the dust collecting part 170.

For example, the first flow path 180*a* may be disposed substantially in parallel with the suction motor axis a1 or the dust bin through line a5. In this case, the suction motor axis a1 or the dust bin through line a5 may penetrate the first flow path 180*a*.

In addition, the second flow path 180*b* may be disposed in a direction parallel to a dust collecting motor axis C. With this configuration, it is possible to minimize a decrease in suction force of the dust collecting motor 191 in the first flow path 180*a* and the second flow path 180*b*.

In this case, the first flow path 180*a* may be provided at a predetermined angle with respect to the second flow path 180*b*. For example, an angle between the first flow path 180*a* and the second flow path 180*b* may be a right angle. With this configuration, it is possible to minimize an overall volume of the cleaner station 100.

Meanwhile, a length of the first flow path 180*a* may be equal to or shorter than a length of the second flow path. With this configuration, the suction force of the dust collecting motor 191 may be transmitted to the space in the dust bin 220 even though the entire flow path for removing the dust is bent once.

The dust in the dust bin 220 of the cleaner 200 may move to the dust collecting part 170 through the flow path part 180.

Meanwhile, the dust suction module 190 will be described below with reference to FIGS. 2 and 10.

The cleaner station 100 may include the dust suction module 190. The dust suction module 190 may include the dust collecting motor 191, a first filter 192, and a second filter (not illustrated).

The dust collecting motor 191 may be disposed below the dust collecting part 170. The dust collecting motor 191 may generate a suction force in the flow path part 180. Therefore, the dust collecting motor 191 may provide a suction force capable of sucking the dust in the dust bin 220 of the cleaner 200.

The dust collecting motor 191 is disposed at a downstream side of the flow path part and provides the suction force to the dust bin through the flow path part. The dust collecting motor 191 is disposed at the lower side of the flow path part 180, and the flow direction in the flow path part 180 is directed downward from above. Therefore, the dust collecting motor 191 may be disposed at the downstream side of the flow path part 180. The dust collecting motor 191 generates the suction force in the flow path part 180, and the flow path part 180 communicates with the dust bin 220. The dust collecting motor 190 may provide the suction force to the dust bin 220 through the flow path part 180.

The dust collecting motor 191 may generate the suction force by means of the rotation. For example, the dust collecting motor 191 may be formed in a shape similar to a cylindrical shape.

Meanwhile, in the present embodiment, an imaginary dust collecting motor axis C may be defined by extending the rotation axis of the dust collecting motor 191.

The first filter 192 may be disposed between the dust collecting part 170 and the dust collecting motor 191. The first filter 192 may be a prefilter.

The second filter (not illustrated) may be disposed between the dust collecting motor 191 and the outer wall surface 112. The second filter (not illustrated) may be an HEPA filter.

Meanwhile, the cleaner station 100 may further include a charging part 128. The charging part may be disposed on the coupling part 120. The charging part 128 may be electrically connected to the cleaner 200 coupled to the coupling part 120. The charging part 128 may supply power to the battery of the cleaner 200 coupled to the coupling part 120.

In addition, the charging part 128 may be electrically connected to a separate cleaner (not illustrated) coupled to the lower region of the housing 110 and supply power to the battery.

In addition, the cleaner station 100 may further include a lateral door (not illustrated). The lateral door may be disposed in the housing 110. The lateral door may selectively expose the dust collecting part 170 to the outside. Therefore, the user may easily remove the dust collecting part 170 from the cleaner station 100.

Figure 10:
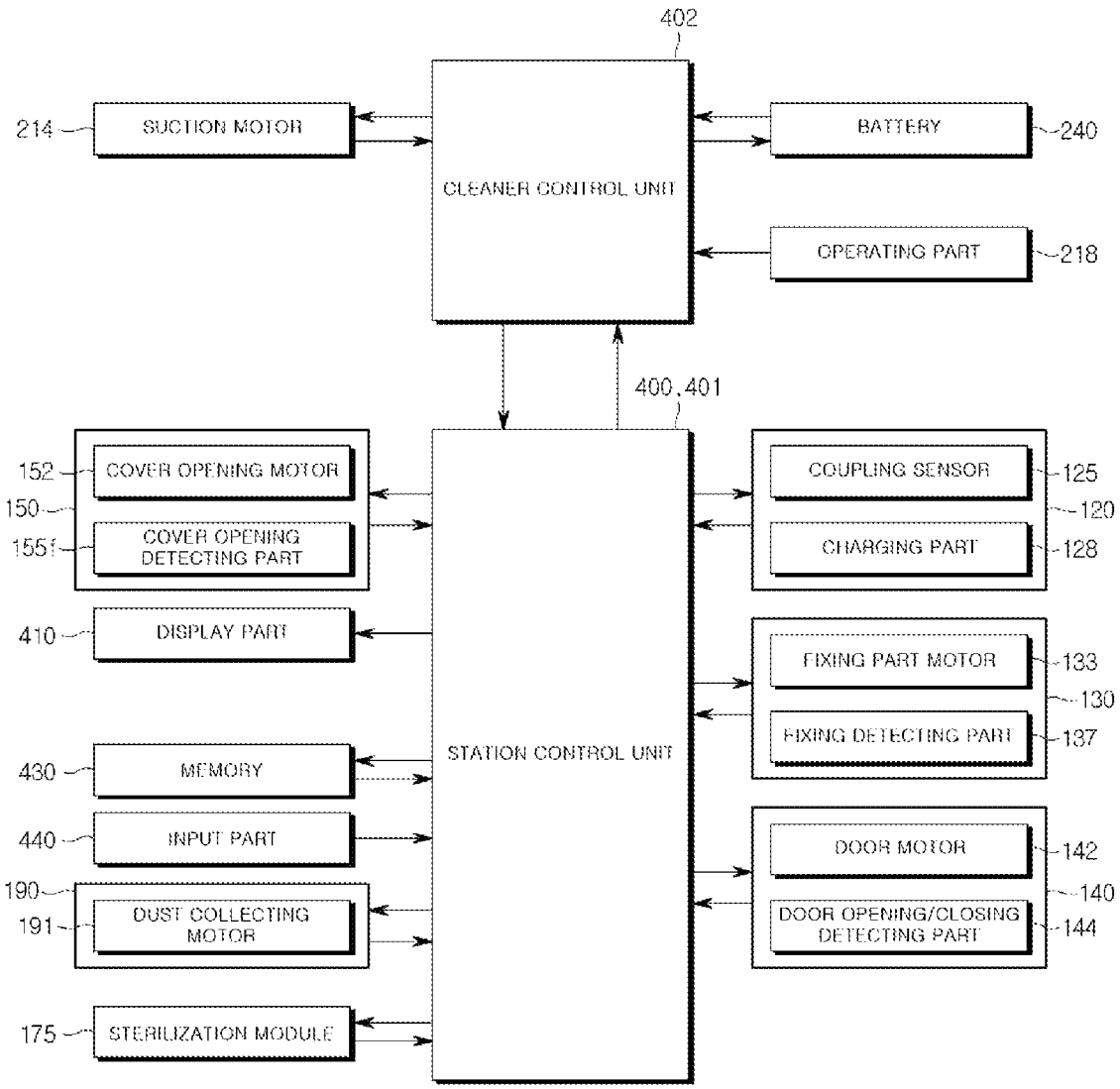
FIG. 10 is a block diagram for explaining a control configuration of the cleaner station according to the embodiment of the present disclosure.

Meanwhile, FIG. 10 is a block diagram for explaining a control configuration of the cleaner station according to the embodiment of the present disclosure.

The control configuration of the cleaner station 100 of the present disclosure will be described below with reference to FIG. 10.

The cleaner station 100 according to the embodiment of the present disclosure may further include a control unit 400 configured to control the coupling part 120, the fixing unit 130, the door unit 140, the cover opening unit 150, the dust collecting part 170, the flow path part 180, and the dust suction module 190.

The control unit 400 may include a printed circuit board and elements mounted on the printed circuit board.

The control unit 400 may include a station control unit 401 configured to control the cleaner station 100, and a cleaner control unit 402 configured to control the cleaner 200. The station control unit 401 and the cleaner control unit 402 may exchange information and process data while performing communication. Hereinafter, the station control unit 401 and the cleaner control unit 402 will be referred to collectively as the control unit 400 unless otherwise noted.

When the coupling sensor 125 detects the coupling of the cleaner 200, the coupling sensor 125 may transmit a signal indicating that the cleaner 200 is coupled to the coupling part 120. In this case, the control unit 400 may receive the signal from the coupling sensor 125 and determine that the cleaner 200 is coupled to the coupling part 120.

In addition, when the charging part 128 supplies power to the battery 240 of the cleaner 200, the control unit 400 may determine that the cleaner 200 is coupled to the coupling part 120.

When the control unit 400 determines that the cleaner 200 is coupled to the coupling part 120, the control unit 400 may operate the fixing part motor 133 to fix the cleaner 200.

When the fixing members 131 or the fixing part links 135 are moved to a predetermined fixing point FP1, a fixing detecting part 137 may transmit a signal indicating that the cleaner 200 is fixed. The control unit 400 may receive the signal, which indicates that the cleaner 200 is fixed, from the fixing detecting part 137, and determine that the cleaner 200 is fixed. When the control unit 400 determines that the cleaner 200 is fixed, the control unit 400 may stop the operation of the fixing part motor 133.

Meanwhile, when the operation of emptying the dust bin 200 is ended, the control unit 400 may rotate the fixing part motor 133 in the reverse direction to release the cleaner 200.

When the control unit 400 determines that the cleaner 200 is fixed to the coupling part 120, the control unit 400 may operate the door motor 142 to open the door 141 of the cleaner station 100.

When the door 141 or the door arm 143 reaches the predetermined opening position DP1, the door opening/closing detecting part 144 may transmit a signal indicating that the door 141 is opened. The control unit 400 may receive the signal, which indicates that the door 141 is opened, from the door opening/closing detecting part 137 and determine that the door 141 is opened. When the control unit 400 determines that the door 141 is opened, the control unit 400 may stop the operation of the door motor 142.

Meanwhile, when the operation of emptying the dust bin 200 is ended, the control unit 400 may rotate the door motor 142 in the reverse direction to close the door 141.

When the control unit 400 determines that the door 141 is opened, the control unit 400 may operate the cover opening motor 152 to open the discharge cover 222 of the cleaner 200.

When the guide frame 151*e* reaches the predetermined opening position CP1, the cover opening detecting part 155*f* may transmit a signal indicating that the discharge cover 222 is opened. The control unit 400 may receive the signal, which indicates that the discharge cover 222 is opened, from the cover opening detecting part 155*f* and determine that the discharge cover 222 is opened. When the control unit 400 determines that the discharge cover 222 is opened, the control unit 400 may stop the operation of the cover opening motor 152.

The control unit 400 may control the sterilization module 175. For example, the control unit 400 may operate the sterilization module 175 after the dust is captured in the dust collecting part 170 or operate the sterilization module 175 at a predetermined time interval, thereby killing viruses, microorganisms, and the like present inside or outside the dust collecting part 170.

The control unit 400 may operate the dust collecting motor 191 to suck the dust in the dust bin 220.

The control unit 400 may operate the display part 410 to display a dust bin emptied situation and a charged situation of the cleaner 200.

Meanwhile, the cleaner station 100 according to the present disclosure may include the display part 410.

The display part 410 may be disposed on the housing 110, disposed on a separate display device, or disposed on a terminal such as a mobile phone.

The display part 410 may be configured to include at least any one of a display panel capable of outputting letters and/or figures and a speaker capable of outputting voice signals and sound. The user may easily ascertain a situation of a currently performed process, a residual time, and the like on the basis of information outputted through the display part.

Meanwhile, the cleaner station 100 according to the embodiment of the present disclosure may include a memory 430. The memory 430 may include various data for operating or driving the cleaner station 100.

Meanwhile, the cleaner station 100 according to the embodiment of the present disclosure may include an input part 440. The input part 440 generates key input data inputted by the user to control the operation of the cleaner station 100. To this end, the input part 440 may include a keypad, a dome switch, a touchpad (resistive touchpad/capacitive touchpad), and the like. In particular, in case that the touchpad defines a mutual layer structure together with the display part 410, the touchpad may be called a touch screen.

Meanwhile, the state in which the cleaner 200 is coupled to the cleaner station 100 will be described below with reference to FIGS. 2 and 3.

In the present disclosure, the cleaner 200 may be mounted on the outer wall surface 112 of the cleaner station 100. For example, the dust bin 220 and the battery housing 230 of the cleaner 200 may be coupled to the coupling surface 121 of the cleaner station 100. That is, the cleaner 200 may be mounted on the first outer wall surface 112*a*.

In this case, the suction motor axis a1 may be defined to be perpendicular to the first outer wall surface 112*a*. That is, the suction motor axis a1 may be defined in parallel with the ground surface. The suction motor axis a1 may be defined on a plane perpendicular to the ground surface. In addition, the suction motor axis a1 may be defined on the plane that perpendicularly intersects the first outer wall surface 112*a*.

The suction flow path through line a2 may be defined in parallel with the first outer wall surface 112*a*. The suction flow path through line a2 may be defined in the gravitational direction. That is, the suction flow path through line a2 may be defined to be perpendicular to the ground surface. In addition, the suction flow path through line a2 may be defined on the plane that perpendicularly intersects the first outer wall surface 112*a*.

The grip portion through line a3 may be defined to be inclined at a predetermined angle with respect to the first outer wall surface 112*a*. In addition, the grip portion through line a3 may be defined to be inclined at a predetermined angle with respect to the ground surface. The grip portion through line a3 may be defined on the plane that perpendicularly intersects the first outer wall surface 112*a*.

The cyclone line a4 may be defined to be perpendicular to the first outer wall surface 112*a*. That is, the cyclone line a4 may be defined in parallel with the ground surface. The cyclone line a4 may be defined on the plane perpendicular to the ground surface. In addition, the cyclone line a4 may be defined on the plane that perpendicularly intersects the first outer wall surface 112*a*.

The dust bin through line a5 may be defined to be perpendicular to the first outer wall surface 112*a*. That is, the dust bin through line a5 may be defined in parallel with the ground surface. The dust bin through line a5 may be defined on the plane perpendicular to the ground surface. In addition, the dust bin through line a5 may be defined on the plane that perpendicularly intersects the first outer wall surface 112*a*.

The dust collecting motor axis C may be defined to be perpendicular to the ground surface. The dust collecting motor axis C may be defined in parallel with at least any one of the first outer wall surface 112*a*, the second outer wall surface 112*b*, the third outer wall surface 112*c*, and the fourth outer wall surface 112*d*.

When the cleaner 200 is coupled to the cleaner station 100, the suction motor axis a1 may intersect the longitudinal axis of the cleaner station 100. That is, the rotation axis of the suction motor 214 may intersect the longitudinal axis of the cleaner station 100.

When the cleaner 200 is coupled to the cleaner station 100, the suction motor axis a1 may intersect the dust collecting motor axis C.

In the state in which the cleaner 200 and the cleaner station 100 are coupled, the suction motor axis a1 may intersect the dust collecting motor axis C at a predetermined angle. For example, an included angle θ1 between the suction motor axis a1 and the dust collecting motor axis C may be 40 degrees or more and 95 degrees or less.

In this case, the included angle may mean an angle defined as the suction motor axis a1 and the dust collecting motor axis C intersect each other, that is, an included angle defined between the suction motor axis a1 and the dust collecting motor axis C.

Meanwhile, when the cleaner 200 is coupled to the cleaner station 100, the handle 216 may be disposed to be farther from the ground surface than is the suction motor axis a1. With this configuration, when the user grasps the handle 216, the relatively heavy suction motor 214 is positioned at the lower side in the gravitational direction, and the user may couple or separate the cleaner 200 to/from the cleaner station 100 only by simply moving the cleaner 200 in the direction parallel to the ground surface. As a result, it is possible to provide convenience for the user.

In addition, when the cleaner 200 is coupled to the cleaner station 100, the battery 240 may be disposed to be farther from the ground surface than is the suction motor axis a1. With this configuration, the cleaner 200 may be stably supported on the cleaner station 100.

When the cleaner 200 is coupled to the cleaner station 100, the suction flow path through line a2 may be defined in parallel with the dust collecting motor axis C. With this configuration, it is possible to minimize an occupied space on a horizontal plane in the state in which the cleaner 200 is coupled to the cleaner station 100.

In this case, the coupling part 120 may be disposed between the suction flow path through line a2 and the dust collecting motor axis C. The fixing member 131 may be disposed between the suction flow path through line a2 and the dust collecting motor axis C. The cover opening unit 150 may be between the suction flow path through line a2 and the dust collecting motor axis C. With this configuration, the user may couple or separate the cleaner 200 to/from the cleaner station 100, fix the dust bin 220, and open the dust bin 220 only by simply moving the cleaner 200 in the direction parallel to the ground surface. As a result, it is possible to provide convenience for the user.

The grip portion through line a3 may intersect the dust collecting motor axis C at a predetermined angle. In this case, an intersection point P6 between the grip portion through line a3 and the dust collecting motor axis C may be positioned in the housing 110. This configuration is advantageous in that the user may couple the cleaner 200 to the cleaner station 100 only by simply pushing his/her arm toward the lateral side of the cleaner station 100 in the state in which the user grasps the cleaner 200. In addition, since the dust collecting motor 191, which is relatively heavy in weight, is accommodated in the housing 110, it is possible to prevent the cleaner station 100 from swaying even though the user strongly pushes the cleaner 200 into the cleaner station 100.

When the cleaner 200 is coupled to the cleaner station 100, the cyclone line a4 may intersect the longitudinal axis of the cleaner station 100. That is, the flow axis of the dust separating part 213 may intersect the longitudinal axis of the cleaner station 100. In this case, the intersection point between the flow axis of the dust separating part 213 and the longitudinal axis of the cleaner station 100 may be positioned in the housing 110, and more particularly, positioned in the flow path part 180.

When the cleaner 200 is coupled to the cleaner station 100, the cyclone line a4 may intersect the dust collecting motor axis C. In this case, an intersection point between the cyclone line a4 and the dust collecting motor axis C may be positioned in the housing 110, and more particularly, positioned in the flow path part 180. With this configuration, the cleaner 200 may be stably supported on the cleaner station 100 in the state in which the cleaner 200 is coupled to the cleaner station 100, and a loss of flow path may be reduced during the operation of emptying the dust bin 220.

When the cleaner 200 is coupled to the cleaner station 100, the dust bin through line a5 may intersect the longitudinal axis of the cleaner station 100. That is, the longitudinal axis of the dust bin 220 may intersect the longitudinal axis of the cleaner station 100. In this case, an intersection point between the longitudinal axis of the dust bin 220 and the longitudinal axis of the cleaner station 100 may be positioned in the housing 110, and more particularly, positioned in a flow path part 180.

Meanwhile, when the cleaner 200 is coupled to the cleaner station 100, the handle 216 may be disposed to be farther from the ground surface than is the dust bin through line a5. With this configuration, when the user grips the handle 216, the user may couple or separate the cleaner 200 to/from the cleaner station 100 only by simply moving the cleaner 200 in the direction parallel to the ground surface. As a result, it is possible to provide convenience for the user.

In addition, when the cleaner 200 is coupled to the cleaner station 100, the battery 240 may be disposed to be farther from the ground surface than is the dust bin through line a5. In this configuration, because the battery 240 pushes the main body 210 of the cleaner 200 by means of the weight of the battery 240, the cleaner 200 may be stably supported on the cleaner station 100.

Figure 11:
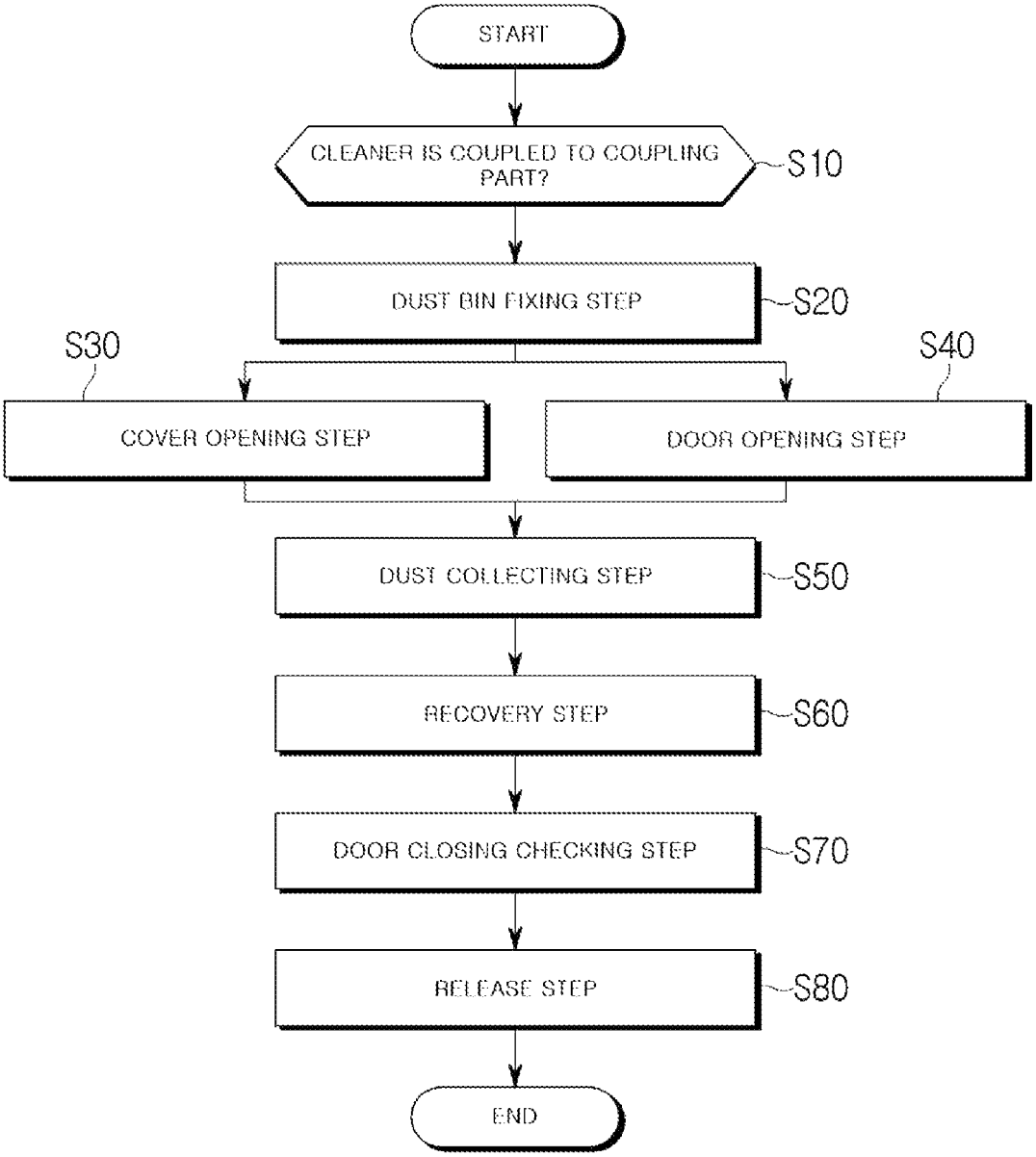
FIG. 11 is a flowchart for explaining a step of operating the cleaner system according to the embodiment of the present disclosure.
Figure 12:
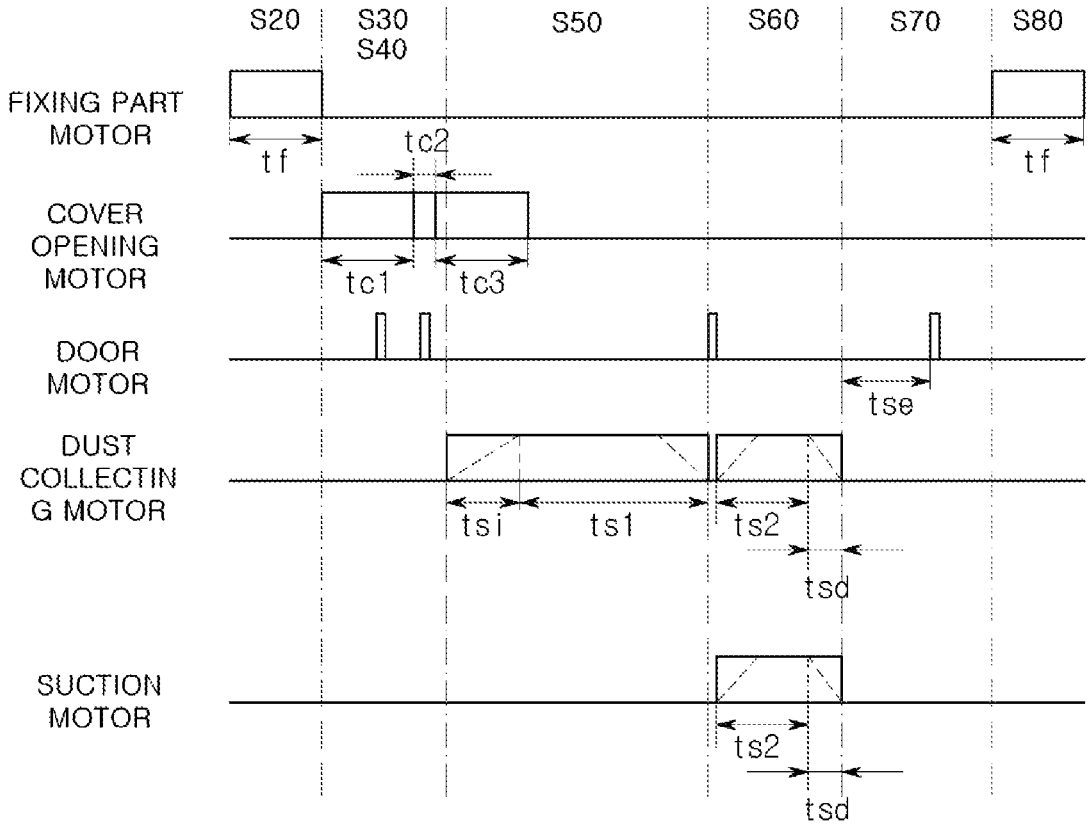
FIG. 12 is a view for explaining operations of motors over time in a method of controlling the cleaner system according to the embodiment of the present disclosure.
Figure 13:
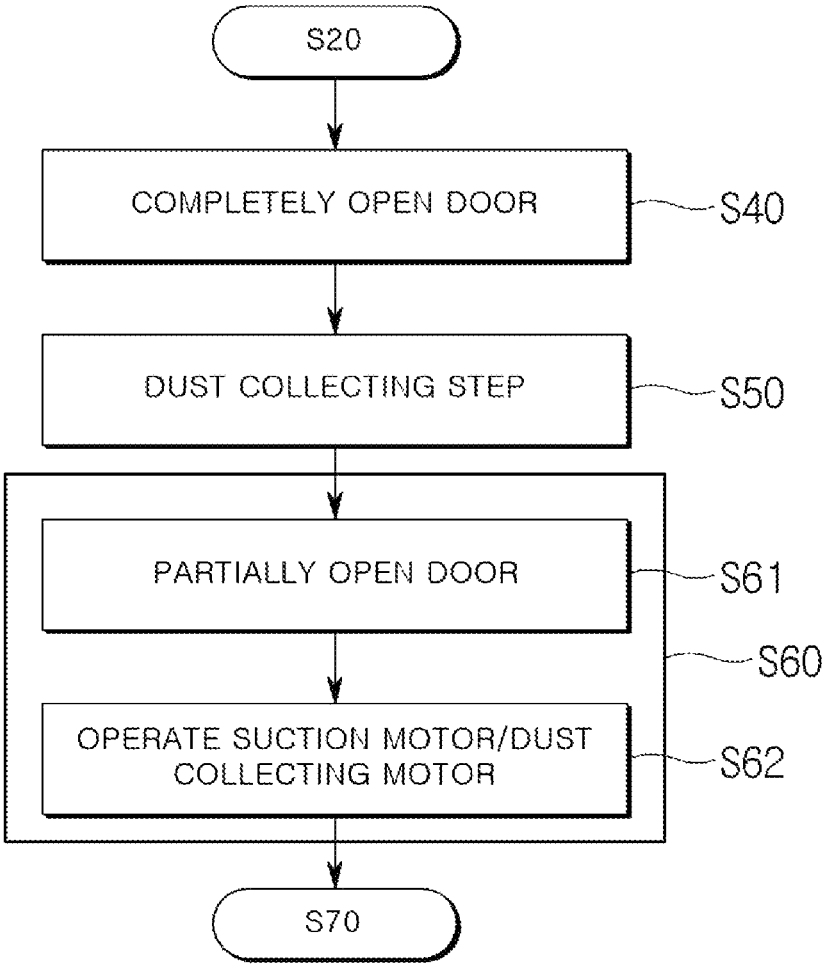
FIG. 13 is a view for explaining a recovery step in accordance with an operation of the door unit in the method of controlling the cleaner system according to the embodiment of the present disclosure.

FIG. 11 is a flowchart for explaining a step of operating the cleaner system according to the embodiment of the present disclosure, and FIG. 12 is a view for explaining operations of motors over time in a method of controlling the cleaner system according to the embodiment of the present disclosure.

A method of controlling the cleaner system according to the present disclosure will be described with reference to FIGS. 11 and 12.

The method of controlling the cleaner system of the present disclosure includes a coupling checking step S10, a dust bin fixing step S20, a cover opening step S30, a door opening step S40, a dust collecting step S50, a recovery step S60, a door closing checking step S70, and a release step S80.

In the coupling checking step S10, whether the cleaner 200 is coupled to the coupling part 120 of the cleaner station 100 may be checked.

Specifically, in the coupling checking step S10, when the cleaner 200 is coupled to the coupling part 120, the coupling sensor 125 disposed on the guide protrusion 123 may come into contact with the battery housing 230, and the coupling sensor 125 may transmit a signal indicating that the cleaner 200 is coupled to the coupling part 120. Alternatively, according to the embodiment, the coupling sensor 125 of a non-contact sensor type disposed on the sidewall 124 may detect the presence of the dust bin 220, and the coupling sensor 125 may transmit a signal indicating that the cleaner 200 is coupled to the coupling part 120.

Therefore, in the coupling checking step S10, the control unit 400 may receive the signal generated by the coupling sensor 125 and determine that the cleaner 200 is coupled to the coupling part 120.

Meanwhile, in the coupling checking step S10 according to the present disclosure, the control unit 400 may determine whether the cleaner 200 is coupled at the exact position on the basis of whether the charging part 128 supplies power to the battery 240 of the cleaner 200. Therefore, in the coupling checking step S10, the control unit 400 may receive the signal, which indicates that the cleaner 200 is coupled, from the coupling sensor 125, and check whether the charging part 128 supplies power to the battery 240, thereby checking whether the cleaner 200 is coupled to the coupling part 120 of the cleaner station 100.

Specifically, when the cleaner 200 is coupled to the coupling part 120 and a corresponding terminal of the cleaner is electrically connected to a charging terminal of the cleaner station 100, the control unit 400 (401) transmits a pulse signal to the cleaner 200 through the corresponding terminal. In this case, the pulse signal may be a signal generated by turning on or off the application of a charging voltage for charging the cleaner 200 a preset number of times at a preset interval. The control unit, which transmits the pulse signal, may be the control unit 401 disposed in the cleaner station.

When the control unit 402 of the cleaner receives the pulse signal, the control unit 402 may operate the suction motor 214 after a preset waiting time has elapsed.

The control unit 400 (401) may adjust an opening angle of the door 141 to a preset angle before the suction motor 214 operates after the operation of the dust collecting motor 191 is completed. A preset angle may be smaller in magnitude than an angle by which the door 141 is opened while the dust collecting motor 191 operates. For example, the preset angle may be an angle β to a flow velocity change position Pc.

In the dust bin fixing step S20, when the cleaner 200 is coupled to the cleaner station 100, the fixing member 131 may hold and fix the dust bin 220.

Specifically, when the control unit 400 receives the signal, which indicates that the cleaner is coupled, from the coupling sensor 125, the control unit 400 may operate the fixing part motor 133 in the forward direction so that the fixing member 131 fixes the dust bin 220. In this case, when the fixing members 131 or the fixing part links 135 are moved to the dust bin fixing position FP1, the fixing detecting part 137 may transmit a signal indicating that the cleaner 200 is fixed. Therefore, the control unit 400 may receive the signal, which indicates that the cleaner 200 is fixed, from the fixing detecting part 137, and determine that the cleaner 200 is fixed. When the control unit 400 determines that the cleaner 200 is fixed, the control unit 400 may stop the operation of the fixing part motor 133.

On the contrary, the control unit 400 may stop the operation of the fixing part motor 133 after operating the fixing part motor 133 in the forward direction for a preset fixed time tf. For example, the control unit 400 may stop the operation of the fixing part motor 133 after operating the fixing part motor 133 in the forward direction for a period of time of 4 second or more and 5 seconds or less.

In the cover opening step S30, the control unit 400 may open the discharge cover 222 of the cleaner 200 when the dust bin 220 is fixed to the cleaner station 100.

When the control unit 400 receives a signal, which indicates that the dust bin 220 is fixed, from the fixing detecting part 137, the control unit 400 may open the discharge cover 222 by operating the cover opening motor 152 in the forward direction (S31).

Specifically, the control unit 400 may operate the cover opening motor 152 in the forward direction. As a result, the push protrusion 151 may depart from the initial position and move to the position at which the push protrusion 151 presses the coupling lever 222*c*. Therefore, the hook engagement between the discharge cover 222 and the dust bin main body 221 is released by the movement of the coupling lever 222*c*, and the discharge cover 222 is rotated in the direction away from the dust bin main body 221 by the restoring force of the torsion spring 222*d*, such that the discharge cover 222 may be separated.

Meanwhile, before the push protrusion 151 presses the coupling lever 222*c*, the cover opening detecting part 155*f* may transmit a signal indicating that the push protrusion 151 is at the initial position.

When the cover opening motor 152 operates and the push protrusion 151 begins to move to press the coupling lever 222*c*, the cover opening detecting part 155*f* may transmit a signal indicating that the push protrusion 151 departs from the initial position. Further, the control unit 400 may receive the signal and determine that the cover opening unit 150 normally operates.

In this case, the control unit 400 may use the timer (not illustrated) to measure the time taken after the cover opening motor 152 is operated in the forward direction or measure the time taken after the push protrusion 151 departs from the initial position.

In this case, the control unit 400 may set and store in advance the time taken until the push protrusion 151 presses the coupling lever 222*c* after departing from the initial position, based on a rotational speed of the cover opening motor 152 and a movement distance of the push protrusion 151. Therefore, the control unit 400 may operate the cover opening motor 152 in the forward direction for a cover opened time tc1 which is equal to or longer than the time taken until the coupling lever 222*c* is pressed. For example, the control unit 400 may operate the cover opening motor 152 in the forward direction for a period of time of 4 seconds or more and 5 seconds or less.

Further, after the cover opened time tc1 has elapsed, the control unit 400 may change the rotation direction of the cover opening motor 152 for a preset rotation direction change time tc2 (S32).

Further, after the rotation direction change time tc2 has elapsed, the control unit 400 may operate the cover opening motor 152 in the reverse direction. As a result, the push protrusion 151 may return back to the initial position again (S33).

The control unit 400 may operate the cover opening motor 152 until the cover opening detecting part 155*f* detects that the push protrusion 151 returns to the initial position. In this case, the control unit 400 may set and store in advance a protrusion return time tc3 taken until the push protrusion 151 returns back to the initial position after the push protrusion 151 pushes the coupling lever 222*c*. Therefore, the control unit 400 may operate the cover opening motor 152 in the reverse direction for the protrusion return time tc3. For example, the control unit 400 may operate the cover opening motor 152 in the reverse direction for a period of time of 4 seconds or more and 5 seconds or less.

Meanwhile, when the control unit 400 receives, from the cover opening detecting part 155*f*, the signal indicating that the push protrusion 151 is returned to the initial position, the control unit 400 may end the operation of the cover opening motor 152.

In the door opening step S40, the control unit 400 may open the door 141 when the dust bin 220 is fixed to the cleaner station 100. Meanwhile, the door opening step S40 may be performed simultaneously with the cover opening step S30.

Specifically, when the control unit 400 receives a signal, which indicates that the dust bin 220 is fixed, from the fixing detecting part 137, and the control unit 400 may operate the door motor 142 in the forward direction, such that the door 141 may open the dust passage hole 121*a* while rotating. That is, in the door opening step S30, the control unit 400 may open the dust passage hole 121*a* by rotating the door 141.

Meanwhile, in the present embodiment, the control unit 400 may operate the door motor 142 in the forward direction when a preset time elapses after the control unit 400 receives a signal, which indicates that the dust bin 220 is fixed, from the fixing detecting part 137. For example, the control unit 400 may operate the door motor 142 when a period of time of 0.5 second or more and 1.5 seconds or less elapses after the dust bin 220 is fixed.

With this configuration, in the cover opening step S30, the control unit may open the door 141 after waiting the time required for the push protrusion 151 to begin to press the coupling lever 222*c*, or the control unit may open the discharge cover 222 and the door 141 in a similar timing. Therefore, it is possible to prevent a situation in which in a state in which the door 141 is rotated first and the dust passage hole 121*a* is opened, the door 141 and the discharge cover 222 strongly collide with each other as the discharge cover 222 is suddenly opened by the restoring force of the torsion spring 222*d* or a situation in which the door 141 is not opened, and the discharge cover 222 and the dust bin main body 221 are not separated even though the hook engagement between the discharge cover 222 and the dust bin main body 221 is released.

Meanwhile, the control unit 400 may open the dust passage hole 121*a* by rotating the door 141 in a stepwise manner. Specifically, the control unit 400 may rotate the door 141 by a preset first opening angle θ1 (S41) and then stop the rotation of the door 141 for a preset time (S42). For example, the control unit 400 may rotate the door 141 by 25 degrees or more and 35 degrees or less and then stop the rotation of the door 141 for a period of time of 4 seconds or more and 5 seconds or less.

In this case, the rotation angle of the door 141 may mean an angle by which the door 141 rotates about a hinge shaft hingedly coupled to the housing 110 based on a position at which the door 141 blocks the dust passage hole 121*a*.

After the rotation of the door 141 is stopped for a preset time, the control unit 400 may further rotate the door 141 by a preset second opening angle θ2. For example, the control unit 400 may further rotate the door 141 by 45 degrees or more and 55 degrees or less (S43).

As a result, when the cover opening step S30 and the door opening step S40 are performed, the discharge cover 222 of the dust bin 220 rotates such that the space in the dust bin main body 221 is opened, and the door 141 rotates such that the dust passage hole 121*a* is opened. Therefore, the internal space of the dust bin 220 may communicate with the flow path part 180 of the cleaner station 100.

Meanwhile, when the door arm 143 moves to the preset door opening position DP1, the door opening/closing detecting part 144 may detect the movement and transmit a signal related to the movement. Therefore, the control unit 400 may determine that the door 141 is opened, and the control unit 400 may stop the operation of the door motor 142.

Alternatively, according to the embodiment, the control unit 400 may detect that the door 141 has been sufficiently rotated on the basis of an electric current value applied to the door motor 142. The control unit 400 may determine that the door 141 is opened on the basis of the detection result, and the control unit 400 may stop the operation of the door motor 142.

The dust collecting step S50, the control unit may operate the dust collecting motor 191 to collect the dust in the dust bin 220 when the discharge cover 222 is opened and the dust passage hole 121*a* is opened by the rotation of the door 141.

The control unit 400 may operate the dust collecting motor 191 when a preset dust collecting waiting time tw elapses after the dust bin 220 is fixed.

For example, the control unit 400 may begin to operate the dust collecting motor 191 when a period of time of 6 seconds or more and 7 seconds or less elapses after the dust bin is fixed. In this case, the control unit 400 may gradually increase a rotational speed of the dust collecting motor 191 to a preset dust collecting speed Ws for a preset suction increase time ts1. For example, the control unit 400 may gradually increase the rotational speed of the dust collecting motor 191 to the dust collecting speed Ws for a period of time of 3 seconds or more and 5 seconds or less. This is advantageous in protecting the dust collecting motor 191 and increasing the lifespan of the dust collecting motor 191 (S51).

In another example, the control unit 400 may begin to operate the dust collecting motor 191 when a period of time of 10 seconds or more and 11 seconds or less elapses after the dust bin is fixed. In this case, the control unit 400 may increase the suction force by increasing the rotational speed of the dust collecting motor 191 to the preset dust collecting speed Ws. This is advantageous in minimizing the operating time of the dust collecting motor 191, improving the energy efficiency, and minimizing the occurrence of noise.

In the dust collecting step S50, the control unit 400 may operate to rotate the dust collecting motor 191 at the dust collecting speed Ws for a preset dust collecting time ts1. For example, in the dust collecting step S50, the control unit 400 may operate to rotate the dust collecting motor 191 at the dust collecting speed Ws for a period of time of 14 seconds or more and 16 seconds or less. However, the present disclosure is not limited thereto. The dust collecting time ts1 may be changed and set depending on the output of the dust collecting motor 191 and the amount of dust stored in the dust bin 220 (S52).

In the dust collecting step S50, the dust in the dust bin 220 may pass through the dust passage hole 121*a* and cleaner flow path part 181 and be collected in the dust collecting part 170. Therefore, the user may remove the dust in the dust bin 220 without a separate manipulation, and as a result, it is possible to provide convenience for the user.

Immediately after the dust collecting step S50, the control unit 400 may set a suction decrease time and gradually decrease the rotational speed of the dust collecting motor 191 from the dust collecting speed Ws.

In the dust collecting step S50, the control unit 400 may stop the dust collecting motor 191 when the dust collecting time ts1 elapses (S53).

In this case, the control unit 400 may gradually decrease the rotational speed of the dust collecting motor 191 from the dust collecting speed Ws for the preset suction decrease time. For example, the control unit 400 may gradually decrease the rotational speed of the dust collecting motor 191 from the dust collecting speed Ws for a period of time of 1 seconds or more and 3 seconds or less. This is advantageous in protecting the dust collecting motor 191 and increasing the lifespan of the dust collecting motor 191.

On the contrary, the control unit 400 may immediately cut off the power applied to the dust collecting motor 191. This is advantageous in minimizing the operating time of the dust collecting motor 191, improving the energy efficiency, and minimizing the occurrence of noise.

According to the present disclosure, the suction motor 214 may operate at least one or more times while the dust collecting motor 191 operates. Assuming that a step of allowing the dust present in the dust bin 220 to flow to the cleaner station 100 by the dust collecting motor 191 is the dust collecting step S50, a step of allowing the dust to flow reversely to the dust bin 220 of the cleaner 200 by the suction motor 214 may be defined as the recovery step S60. According to the present disclosure, the suction motor 214 may operate at least one or more times while the dust collecting motor 191 operates, such that the dust caught by the discharge port of the dust bin 220 may be recovered into the dust bin 220.

In the recovery step S60, the flow direction of the air is changed reversely after the dust collecting step S50, the dirt, such as hairs and dust, which is caught by the dust bin 220 and remains in the discharge port of the dust bin 220 without flowing to the cleaner station 100, may be recovered back into the dust bin 220. Therefore, the dust bin 220 may be completely sealed when the discharge cover 222 covers and closes the discharge port of the dust bin 220.

In the recovery step S60, the suction motor 214 operates, such that the dust present in the discharge port of the dust bin 220 is sucked into the dust bin. In this case, in the recovery step S60, the dust collecting motor 191 may operate at least one or more times while the suction motor 214 operates. When the dust collecting motor 191 operates, the flow direction of the air may be changed such that the dust may be sucked into the dust bin, or a complicated turbulent flow may be generated such that the sucked dust may be more effectively removed.

The flow direction in the recovery step S60 is opposite to the flow direction in the flow path part 180 in the dust collecting step S50. In the dust collecting step S50, the air in the flow path part 180 flows in a first direction. The first direction is defined as a direction from the dust bin 220 of the cleaner toward the dust collecting part 170 of the cleaner station. In the recovery step S60, the air in the flow path part 180 flows in a second direction. The second direction is defined as a direction from the dust collecting part 170 of the cleaner station toward the dust bin 220 of the cleaner. That is, in the flow path part 180, the flow direction in the recovery step S60 is opposite to the flow direction in the dust collecting step S50.

According to the present disclosure, the flow direction of the dust in the flow path part 180 is changed reversely at least one or more times. In this case, the flow direction of the dust is controlled by changing at least any one of the suction force of the suction motor 214 and the suction force of the dust collecting motor 191.

Alternatively, the flow direction of the dust is controlled by changing at least any one of the rotational speed of the suction motor 214 and the rotational speed of the dust collecting motor 191. For example, in case that only the dust collecting motor 191 operates or the rotational speed of the dust collecting motor 191 is higher than the rotational speed of the suction motor 214, the flow direction in the flow path part 180 is directed toward the cleaner station 100 from the dust bin 220. On the contrary, in case that only the suction motor 214 operates or the rotational speed of the suction motor 214 is higher than the rotational speed of the dust collecting motor 191, the flow direction in the flow path part 180 is directed toward the dust bin 220 from the cleaner station 100.

That is, the suction force of the dust collecting motor 191 or the suction force of the suction motor 214 is proportional to the rotational speed of the dust collecting motor 191 or the rotational speed of the suction motor 214.

The flow direction in the flow path part 180 is directed toward the cleaner station 100 from the dust bin 220 and then changed reversely, such that the flow direction in the flow path part 180 is directed toward the dust bin 220 from the cleaner station 100. The flow direction in the flow path part 180 is directed toward the cleaner station 100 from the dust bin 220 first, such that dust loosely caught by an obstacle is sucked into the cleaner station 100 by a negative pressure. Therefore, the dust firmly caught by the obstacle remains in the discharge port of the dust bin 220. Therefore, the flow direction may be changed to be directed toward the dust bin 220 from the cleaner station 100, such that the remaining dust may be recovered into the dust bin 220.

At least any one of the suction force of the suction motor 214 and the suction force of the dust collecting motor 191 is changed. Specifically, the suction force of the suction motor 214 is changed at least one or more times, and the flow direction of the dust in the flow path part 180 is changed reversely at least one or more times. For example, the suction motor 214 may be controlled to be turned on or off. The air in the flow path part 180 may flow from the dust bin 220 to the dust collecting part 170 while the suction motor 214 is turned off. The air in the flow path part 180 may flow from the dust collecting part 170 to the dust bin 220 while the suction motor 214 is turned on. Alternatively, the suction force changes in magnitude while the suction motor 214 continuously operates. When the suction force is high, the air in the flow path part 180 may flow from the dust bin 220 to the dust collecting part 170. When the suction force is low, the air in the flow path part 180 may flow from the dust collecting part 170 to the dust bin 220.

The suction motor 214 and the dust collecting motor 191 may operate simultaneously. In this case, the suction force of the suction motor 214 may be higher than the suction force of the dust collecting motor 191 for a preset time. Therefore, in case that the suction motor 214 and the dust collecting motor 191 operate simultaneously, the air in the flow path part 180 may flow from the dust collecting part 170 to the dust bin 220. In case that the suction motor 214 is stopped and only the dust collecting motor 191 operates, the air in the flow path part 180 may flow from the dust bin 220 to the dust collecting part 170.

Any one of the suction force of the suction motor 214 and the suction force of the dust collecting motor 191 may be selectively changed. Alternatively, both the suction force of the suction motor 214 and the suction force of the dust collecting motor 191 may be changed. In this case, the suction force of the suction motor 214 may be set to be higher than the suction force of the dust collecting motor 191, such that the dust may flow reversely and be recovered into the dust bin 220.

The suction force of the suction motor 214 may be higher than the suction force of the dust collecting motor 191 for a preset time. The preset time may be all the periods of time in the recovery step. Alternatively, the preset time may be a part of the period of time in the recovery step.

According to the embodiment of the present disclosure, at least any one of the suction motor 214 and the dust collecting motor 191 may be controlled by being turned on or off.

For example, the suction motor 214 may be turned on or off, and the dust collecting motor 191 may continuously operate. In this case, in case that the suction force of the suction motor 214 is higher than the suction force of the dust collecting motor 191, the dust is recovered into the dust bin 220 while the suction motor 214 operates.

On the contrary, the dust collecting motor 191 may be turned on or off, and the suction motor 214 may continuously operate. In this case, the dust is recovered into the dust bin 220 while the dust collecting motor 191 is turned off.

Alternatively, both the suction motor 214 and the dust collecting motor 191 may be turned on or off. In this case, the time for which the suction motor 214 and the dust collecting motor 191 are turned on or off may vary.

According to the embodiment, after the operation of the dust collecting motor 191 is started, the suction force may change at least one or more times. When the dust collecting motor 191 operates in the dust collecting step S50, the air may flow from the dust bin 220 to the dust collecting part 170. When the suction force of the dust collecting motor 191 is changed in the recovery step S60 after the dust collecting step S50, the air may flow from the dust collecting part 170 to the dust bin 220.

According to the embodiment of the present disclosure, at least any one of the suction motor 214 and the dust collecting motor 191 may continuously operate and be controlled as the rotational speed changes. The suction motor 214 and the dust collecting motor 191 may continuously operate. In this case, the suction motor 214 or the dust collecting motor 191 may be controlled as the rotational speed changes. For example, in case that the rotational speed of the suction motor 214 is higher than the rotational speed of the dust collecting motor 191, the flow direction is directed toward the cleaner station 100 from the dust bin 220. On the contrary, when the rotational speed of the suction motor 214 is lower than the rotational speed of the dust collecting motor 191, the flow direction is directed toward the dust bin 220 from the cleaner station 100.

The direction of the suction force provided to the dust bin 220 by the suction motor 214 may be opposite to the direction of the suction force provided to the dust bin 220 by the dust collecting motor 191. The suction motor 214 may be disposed to be opposite to the dust collecting motor 191 based on the dust bin 220. For example, the suction motor 214 is disposed above the dust bin 220 and sucks the air upward from the dust bin 220. In contrast, the dust collecting motor 191 is disposed below the dust bin 220 and sucks the air downward from the dust bin 220.

The door 141 may operate before at least any one of the suction motor 214 and the dust collecting motor 191 operates.

In the recovery step S60, the control unit 400 may rotate the door 141 by operating the door motor 142. In this case, the door 141 may rotate to a position at which the door 141 may change the flow velocity of the air to be sucked into the dust collecting motor 191 (S61).

The recovery step S60 may be divided into at least two steps. After an opening area of the dust passage hole 121*a* is changed by the operation of the door unit 140 (S61), the suction motor 214 or the dust collecting motor 191 operates to recover the remaining dust into the dust bin 220 (S62).

The door opening step S40, which is performed before the dust collecting step S50, may be referred to as a complete door opening step S40 so as to be distinguished from the step S61. The step S61 may be referred to as a partial door opening step S61 so as to be distinguished from the complete opening step S40.

In the partial door opening step S61, a size of a cross-sectional area of the dust passage hole 121*a* is changed as the door 141 operates. Therefore, the flow velocity changes in the discharge port of the dust bin 220.

When the door arm 143 moves to the preset flow velocity control position DP3, the door opening/closing detecting part 144 may detect the movement and transmit a signal related to the movement. Therefore, the control unit 400 may determine that the door 141 rotates to the position at which the door 141 may change the flow velocity of the air, and the control unit 400 may stop the operation of the door motor 142.

Alternatively, according to the embodiment, the control unit 400 may use the rotational speed of the door motor 142, the operating time of the door motor 142, and the like to determine whether the door 141 rotates to the position at which the door 141 may change the flow velocity of the air, and the control unit 400 may stop the operation of the door motor 142.

In the recovery step S60, the door 141 may rotate within an angle range of 10 degrees or more and 90 degrees or less based on a closing position Ps at which the dust passage hole 121*a* is closed.

Figure 14:
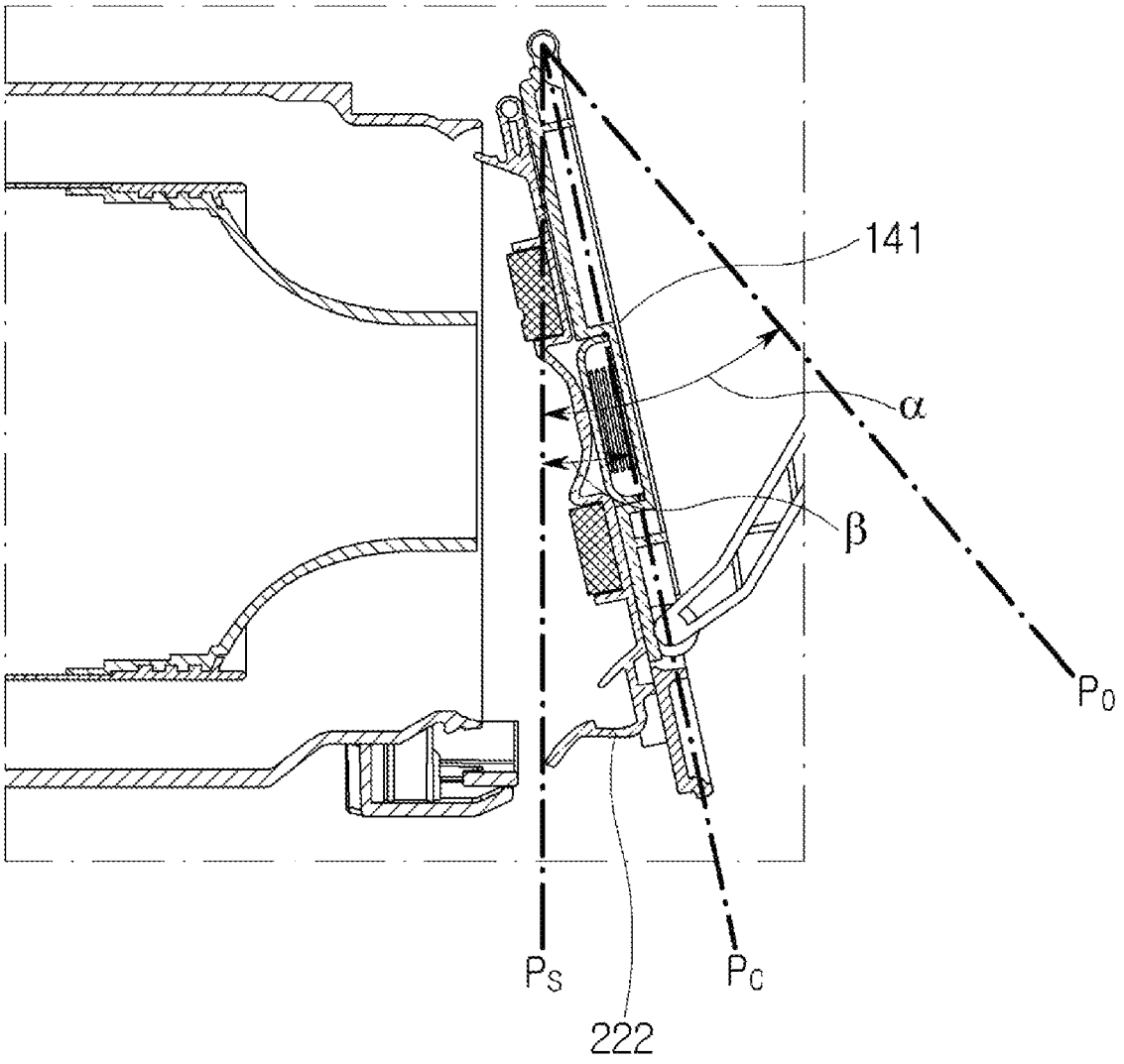
FIG. 14 is a view illustrating an opening/closing degree of a discharge cover in accordance with an operation of the door unit in FIG. 13.

Specifically, with reference to FIG. 14, in the door opening step S40, the door 141 may be rotated from the closing position Ps to an opening position Po and then stopped. In the dust collecting step S50, the door 141 may be kept at the opening position Po. In the recovery step S60, the door 141 may be rotated to the flow velocity change position Pc. In this case, an angle $\alpha$ from the closing position Pc to the opening position Po may be larger than an angle $\beta$ from the closing position Ps to the flow velocity change position Pc. For example, the angle $\alpha$ from the closing position Pc to the opening position Po may be 70 degrees or more and 90 degrees or less, and the angle $\beta$ from the closing position Ps to the flow velocity change position Pc may be 10 degrees or more and 35 degrees or less. That is, an angle ($\alpha$-$\beta$) from the opening position Pc to the flow velocity change position Pc may be 10 degrees or more and 90 degrees or less based on the closing position Ps.

In the recovery step S60, the discharge cover 222 may rotate in conjunction with the rotation of the door 141.

The discharge cover 222 may rotate from the opening position Po to the flow velocity change position Ps. In this case, a position of the discharge cover 222 may be expressed as an angle defined between one end of the dust bin main body 221 based on the longitudinal direction (an end based on the direction of the cleaner station) and the discharge cover 222 in a state in which the dust bin 220 is coupled to the cleaner station 100. Therefore, a position of the discharge cover 222 may be expressed as a cover closing position when the discharge cover 222 is coupled to the dust bin main body 221 and closes the dust bin 220. Further, because the discharge cover 222 may rotate together with the door 141 in conjunction with the rotation of the door 141 in the state in which the discharge cover 222 and the door 141 are in contact with each other, the description of the opening position Po and the flow velocity change position Pc of the door 141 may also be applied to the cover opening position and the cover flow velocity change position of the discharge cover 222.

Therefore, in the recovery step S60, an angle of the discharge cover 222 at the cover flow velocity change position with respect to one end of the dust bin main body 221 based on the longitudinal direction may be smaller than an angle of the discharge cover 222 at the cover opening position with respect to one end of the dust bin main body 221 based on the longitudinal direction. For example, at the cover flow velocity change position, the angle $\beta$ defined between one end of the dust bin main body 221 based on the longitudinal direction and the discharge cover 222 may be 10 degrees or more and 35 degrees or less. At the cover opening position, the angle $\alpha$ defined between one end of the dust bin main body 221 based on the longitudinal direction and the discharge cover 222 may be 70 degrees or more and 90 degrees or less.

Therefore, in the recovery step S60, the opening area of the dust passage hole 121*a* may be changed as the door 141 rotates before the suction motor 214 operates. In addition, in the recovery step S60, an area in which the internal space of the dust bin 220 is opened may be changed.

With this configuration, in the recovery step S60, the flow velocity of the air passing through the dust passage hole 121*a* may be changed. Specifically, the flow velocity of the air passing through the dust passage hole 121*a* in the recovery step S60 may be higher than the flow velocity of the air passing through the dust passage hole 121*a* in the dust collecting step S50. That is, in the present embodiment, the flow rate of the air in the dust passage hole 121*a* is maintained, whereas the opening area of the dust passage hole 121*a* is changed, such that the flow velocity of the air passing through the dust passage hole 121*a* is changed.

Before the dust collecting motor 191 operates, the door 141 may operate to completely open the dust passage hole 121*a*. In addition, before the suction motor 214 operates after the dust passage hole 121*a* is completely opened, the door 141 may operate to open only a part of the dust passage hole 121*a*. In the dust collecting step S50, the dust passage hole 121*a* is completely opened. Therefore, a large amount of dust passes through the dust passage hole 121*a* and flows to the cleaner station 100. In contrast, only a part of the dust passage hole 121*a* is opened in the recovery step S60. Therefore, because the dust is sucked by the high flow velocity, the remaining dust, such as hairs, caught by the dust bin 220 may be more effectively sucked and recovered into the dust bin 220.

Hereinafter, the recovery step S60 according to a first embodiment will be described with reference to FIG. 15.

According to the first embodiment, the dust collecting motor 191 may consistently operate, and the suction motor 214 may be controlled by being turned on or off. That is, the suction motor 214 may operate intermittently.

According to the first embodiment, the rotational speed of the suction motor 214 is higher than the rotational speed of the dust collecting motor 191, and the suction force of the suction motor 214 is higher than the suction force of the dust collecting motor 191. Therefore, when the suction motor 214 and the dust collecting motor 191 operate simultaneously, the flow direction is directed toward the dust bin 220 from the cleaner station 100.

According to the first embodiment, when the suction motor 214 operates, the flow direction is directed toward the dust bin 220 from the cleaner station 100, and the dust is sucked into the dust bin 220. On the contrary, when the suction motor 214 does not operate, the flow direction is directed toward the cleaner station 100 from the dust bin 220, and the dust is sucked into the cleaner station 100.

Figure 15:
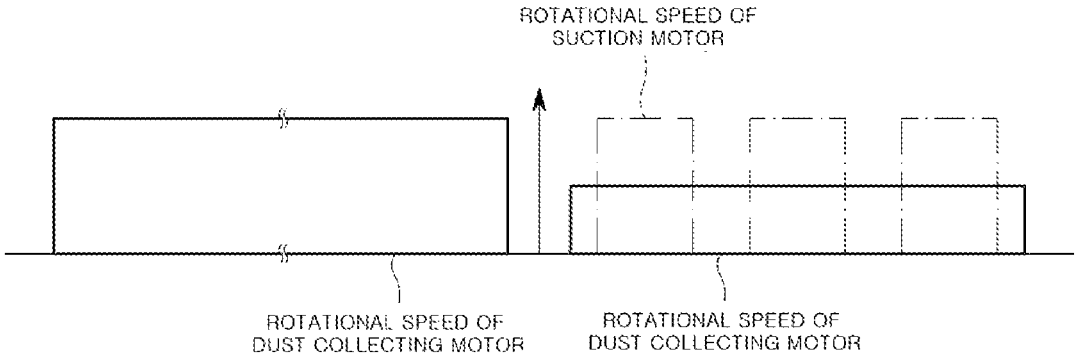
FIG. 15 is a view illustrating operations of a suction motor and a dust collecting motor according to a first embodiment of the present disclosure.

With reference to FIG. 15, when the operation mode is changed, the suction motor 214 may begin to operate after the dust collecting motor 191 operates. The change in operation mode refers to a configuration in which the dust collecting step S50 ends, and the recovery step S60 starts. When the recovery step S60 starts, the dust collecting motor 191 operates first and sucks the dust into the dust collecting part 170, such that the dust deposited in the flow path part 180 between the dust collecting step S50 and the recovery step S60 may be captured in the dust collecting part again before the dust is recovered into the dust bin 220.

Alternatively, unlike FIG. 15, when the operation mode is changed, the suction motor 214 may operate before the dust collecting motor 191 operates.

With reference to FIG. 15, the suction motor 214 may operate in the form of a pulse. In this case, the control unit may control and turn on or off the suction motor 214 by applying a voltage in the form of a pulse to the suction motor 214.

Hereinafter, the recovery step S60 according to a second embodiment will be described with reference to FIG. 16.

The above-mentioned description of the recovery step S60 according to the first embodiment may be applied to the recovery step S60 according to the second embodiment as long as these steps do not conflict with each other. Hereinafter, the description will be focused on a difference between the recovery step S60 according to the second embodiment and the recovery step S60 according to the first embodiment.

According to the second embodiment, the dust collecting motor 191 may be controlled by being turned on or off, and the suction motor 214 may consistently operate. That is, the dust collecting motor 191 may intermittently operate.

According to the second embodiment, the rotational speed of the dust collecting motor 191 is higher than the rotational speed of the suction motor 214, and the suction force of the dust collecting motor 191 is higher than the suction force of the dust collecting motor 191. Therefore, when the dust collecting motor 191 and the suction motor 214 operate simultaneously, the flow direction is directed toward the cleaner station 100 from the dust bin 220.

According to the second embodiment, when the dust collecting motor 191 operates, the flow direction is directed toward the cleaner station 100 from the dust bin 220, and the dust is captured in the dust collecting part. On the contrary, when the dust collecting motor 191 does not operate, the flow direction is directed toward the dust bin 220 from the cleaner station 100, and the dust is recovered into the dust bin 220.

Figure 16:
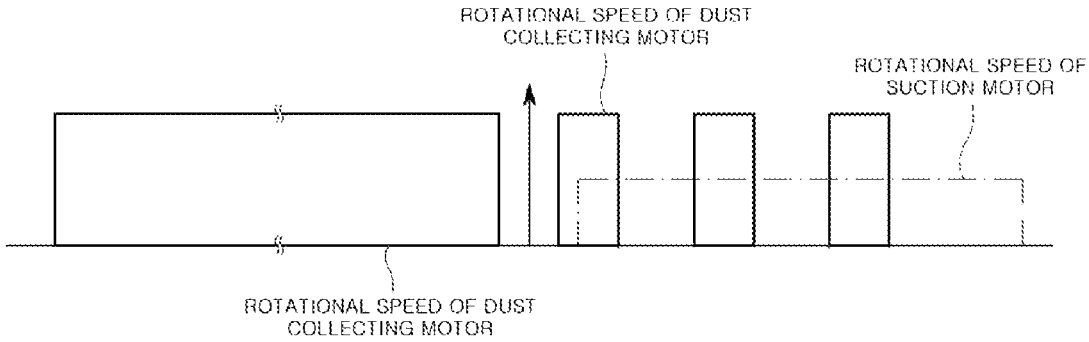
FIG. 16 is a view illustrating operations of the suction motor and the dust collecting motor according to a second embodiment of the present disclosure.

With reference to FIG. 16, when the recovery step S60 starts, the dust collecting motor 191 operates first and sucks the dust into the dust collecting part 170. Thereafter, when the dust collecting motor 191 is stopped, the dust may be recovered into the dust bin 220 by the suction motor 214.

Alternatively, unlike FIG. 16, when the recovery step S60 starts, the suction motor 214 operates first and recover the dust into the dust bin 220. Thereafter, when the dust collecting motor 191 operates, the dust may be captured in the dust collecting part 170 by the dust collecting motor 191.

With reference to FIG. 16, the dust collecting motor 191 may operate in the form of a pulse. In this case, the control unit may control and turn on or off the dust collecting motor 191 by applying a voltage in the form of a pulse to the dust collecting motor 191.

Hereinafter, the recovery step S60 according to a third embodiment will be described with reference to FIG. 17.

The above-mentioned description of the recovery step S60 according to the first and second embodiments may be applied to the recovery step S60 according to the third embodiment as long as these steps do not conflict with each other. Hereinafter, the description will be focused on a difference between the recovery step S60 according to the third embodiment and the recovery steps according to the first and second embodiments.

With reference to FIG. 17A, a rotational speed value of the suction motor 214 may include a first suction speed Wb1 and a second suction speed Wb2. In this case, the second suction speed Wb2 is higher than the first suction speed Wb1. The first suction speed Wb1 and the second suction speed Wb2 of the suction motor 214 are alternately implemented, and the suction motor 214 may be turned off for a predetermined time before the rotational speed is changed.

The recovery step S60 according to the third embodiment and the recovery step S60 according to the first embodiment are identical to each other in that the suction motor 214 is controlled and turned on or off, but different from each other in that the rotational speed of the suction motor 214 changes.

According to the third embodiment, because the suction motor 214 is stopped or operates at the first suction speed Wb1 or the second suction speed Wb2, the suction force of the suction motor 214 three-dimensionally varies in at least three steps, such that the remaining dust caught by the dust bin 220 may be efficiently recovered into the dust bin 220. In addition, an irregular airflow may be formed, thereby more effectively removing the dust.

Unlike the illustration in FIG. 17A, with reference to FIG. 17B, the dust collecting motor 191 may operate while the suction motor 214 is turned off. In FIG. 17A, no external force is applied to the remaining dust while the suction motor 214 is stopped. However, in FIG. 17B, an external force is applied in the opposite direction to the remaining dust while the suction motor 214 is stopped, such that the remaining dust may be more effectively separated.

Figure 17:
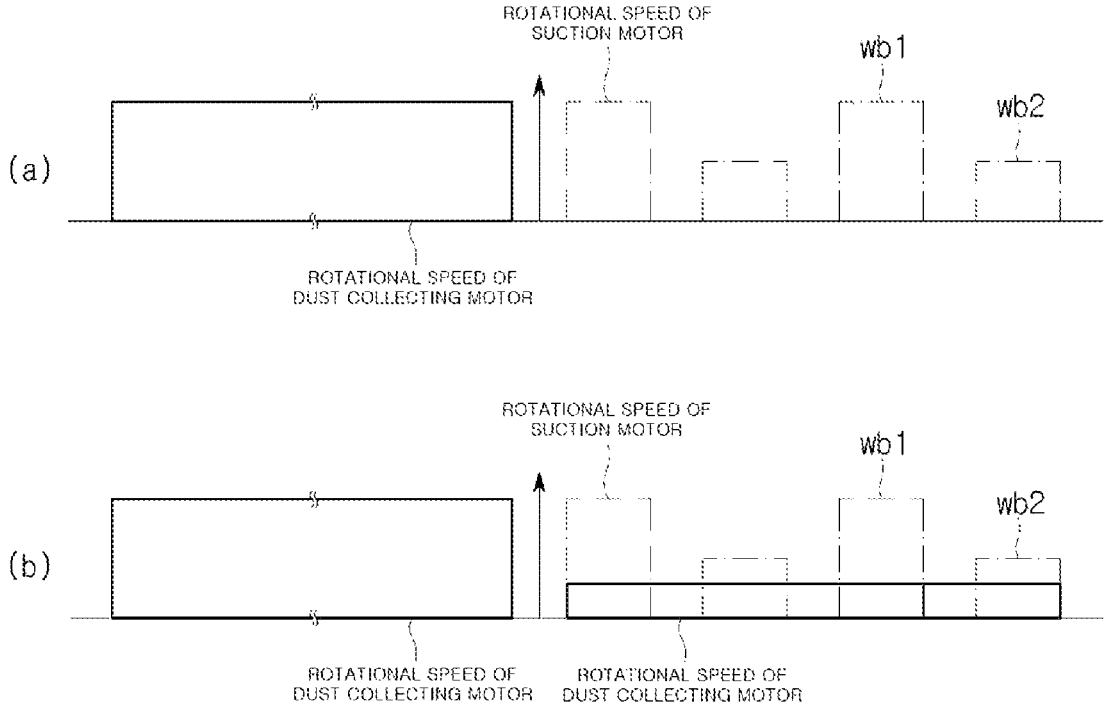
FIG. 17 is a view illustrating operations of the suction motor and the dust collecting motor according to a third embodiment of the present disclosure.

Unlike the illustration in FIG. 17, the suction motor 214 may continuously operate, and the dust collecting motor 191 is controlled by being turned on or off, such that the rotational speed of the dust collecting motor 191 may be controlled to be changed.

Figure 18:
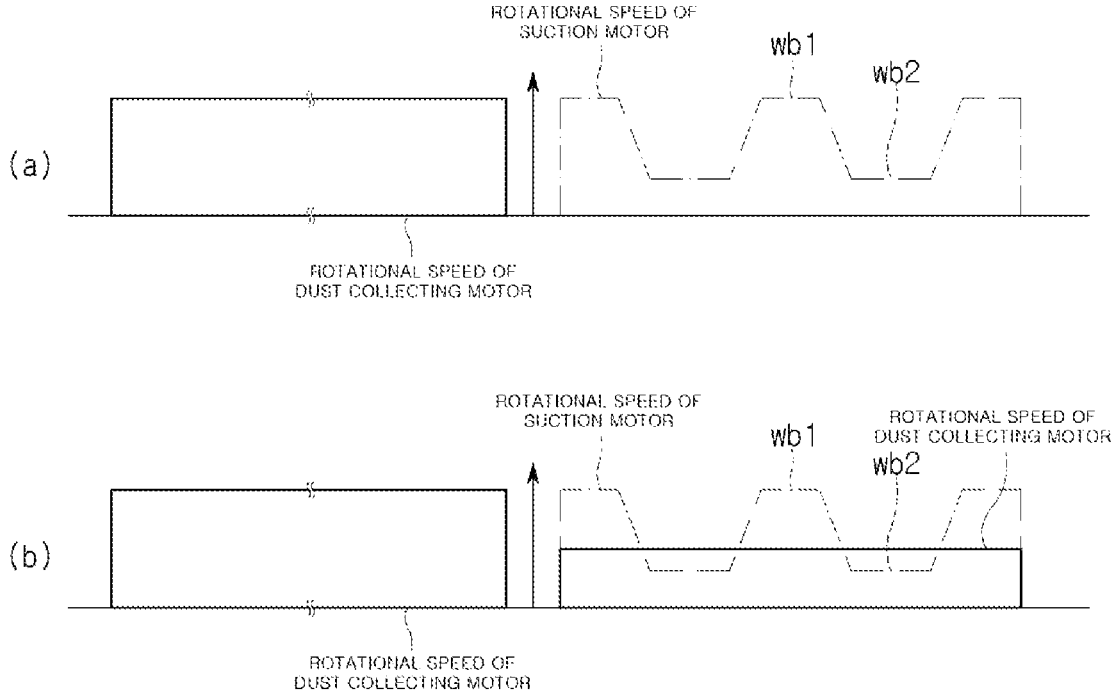
FIG. 18 is a view illustrating operations of the suction motor and the dust collecting motor according to a fourth embodiment of the present disclosure.

Hereinafter, the recovery step S60 according to a fourth embodiment will be described with reference to FIG. 18.

The above-mentioned description of the recovery step S60 according to the first to third embodiments may be applied to the recovery step S60 according to the fourth embodiment as long as these steps do not conflict with each other. Hereinafter, the description will be focused on a difference between the recovery step S60 according to the fourth embodiment and the recovery step S60 according to the first to third embodiments.

With reference to FIG. 18A, the rotational speed value of the suction motor 214 may include the first suction speed Wb1 and the second suction speed Wb2. In this case, the second suction speed Wb2 is lower than the first suction speed Wb1.

The first suction speed Wb1 and the second suction speed Wb2 of the suction motor 214 are alternately implemented, and the rotational speed may be continuously changed for a predetermined time when the suction speed is changed.

The control unit 400 may gradually change the rotational speed of the suction motor 214 between the first suction speed Wb1 and the second suction speed Wb2 for a preset time tb. For example, the control unit may gradually decrease the rotational speed of the suction motor 214 from the first suction speed Wb1 to the second suction speed Wb2. On the contrary, the control unit may gradually increase the rotational speed of the suction motor 214 from the second suction speed Wb2 to the first suction speed Wb1. This is advantageous in protecting the suction motor 214 and increasing the lifespan of the suction motor 214.

Unlike the illustration in FIG. 18A, with reference to FIG. 18B, the dust collecting motor 191 may also operate while the suction motor 214 operates. In this case, the rotational speed of the dust collecting motor 191 may be lower than the first suction speed Wb1.

In FIG. 18A, the suction motor 214 always operates during the recovery step S60, and an external force is applied to the dust always in the same direction. In contrast, in FIG. 18B, the external force in the opposite direction is applied to the dust while the suction motor 214 rotates at the second suction speed Wb2. Therefore, the forces, which are applied in different directions, may be alternately applied to the remaining dust in the forward/rearward direction, such that the remaining dust may be more effectively separated. In addition, an irregular airflow may be formed, thereby more effectively removing the dust.

The control unit 400 may gradually decrease the rotational speed of the suction motor 214 and the rotational speed of the dust collecting motor 191 for the preset suction decrease time. This is advantageous in protecting the suction motor 214 and the dust collecting motor 191 and increasing the lifespan of the suction motor 214 and the lifespan of the dust collecting motor 191.

On the contrary, the control unit 400 may immediately cut off the power applied to the suction motor 214 and the dust collecting motor 191. This is advantageous in minimizing the operating time of the suction motor 214 and the operating time of the dust collecting motor 191, improving the energy efficiency, and minimizing the occurrence of noise.

In the recovery step S60 according to the present disclosure, the dust, such as hairs, remaining in the discharge port of the dust bin 220 may be sucked and recovered into the dust bin 220.

In the related art, in case that only the dust collecting step S50 is provided without the recovery step S60, a part of hair or dust may be caught by one side of the dust bin 220 and elongated toward the flow path part 180. For this reason, the dust remains in the discharge port of the dust bin 220 without being captured in the dust collecting part 170. When the discharge port of the dust bin 220 is closed by the discharge cover 222 as the door unit 140 operates in this state, the remaining dust is trapped, and the dust bin 220 cannot be completely sealed, which inconveniences the user because the user needs to manually open the dust bin 220 again, remove the dust, and then close the dust bin 220 again.

In contrast, in the recovery step S60 according to the present disclosure, the airflow is generated in the reverse direction, and the remaining dust is recovered back into the dust bin 220, such that the dust is not present any further in the discharge port of the dust bin 220. Therefore, the user need not remove the remaining dust, and the dust bin 220 may be automatically closed as the door unit 140 operates.

Further, the opening area of the dust passage hole 121*a* may be reduced before the suction motor 214 operates at the initial time of the recovery step S60. Therefore, it is possible to effectively recover the remaining dust into the dust bin 220 even though the rotational speed of the suction motor 214 is low.

In addition, in the recovery step S60, the suction motor 214 or the dust collecting motor 191 may be variously controlled, such that it is possible to perform the effective control mode depending on the circumstances.

Meanwhile, the method of controlling the cleaner station 100 according to the embodiment of the present disclosure may further include a door closing checking step S70 of opening at least a part of the dust passage hole 121*a* and then closing the dust passage hole 121*a* again by rotating the door 141 after the operation of the dust collecting motor 191 ends.

Specifically, when a preset suction end time tse elapses after the operation of the dust collecting motor 191 ends, the control unit 400 may rotate the door motor 142 in the forward direction and then rotate the door motor 142 in the reverse direction again.

For example, when a period of time of 3 seconds or more and 11 seconds or less, particularly 9 seconds or more and 11 seconds or less elapses after the operation of the dust collecting motor 191 ends, the control unit 400 may operate the door motor 142 in the forward direction and rotate the door 141 to the flow velocity change position Pc. Thereafter, the control unit 400 may operate the door motor 142 in the reverse direction and rotate the door 141 to the closing position Ps.

This is to prevent the dust passage hole 121*a* from being finely opened by a negative pressure generated by the operation of the dust collecting motor 191 because the dust collecting motor 191 operates in the recovery step S60 in the state in which the dust passage hole 121*a* is closed. Therefore, in the door closing checking step S70, the door 141 blocks the dust passage hole 121*a* once again after the operation of the dust collecting motor 191 ends, which may prevent a reverse flow of dust that may be present in the flow path part 180.

In the release step S80, when the door 141 is closed, the fixing part motor 133 may be operated, such that the fixing member 131 may release the dust bin 220.

Specifically, the control unit 400 may release the dust bin 220 when the control unit 400 receives a signal, which indicates that the door 141 closes the dust passage hole 121*a*, from the door opening/closing detecting part 144.

That is, when the door arm 143 moves to the preset door closing position DP2, the door opening/closing detecting part 144 may detect the movement and transmit a signal related to the movement. Therefore, the control unit 400 may determine that the door 141 closes the dust passage hole 121*a*, and the control unit 400 may operate the fixing part motor 133 in the reverse direction to release the dust bin 220.

Alternatively, according to the embodiment, the control unit 400 may detect that the door 141 has been rotated to sufficiently close the dust passage hole 121*a* on the basis of the electric current value applied to the door motor 142. The control unit 400 may determine that the door 141 has closed the dust passage hole 121*a* on the basis of the detection result, and the control unit 400 may operate the fixing part motor 133 in the reverse direction to release the dust bin 220.

In this case, when the fixing member 131 or the fixing part link 135 is moved to the releasing position FP2, the fixing detecting part 137 may transmit a signal indicating that the cleaner 200 is released.

Therefore, the control unit 400 may receive the signal, which indicates that the cleaner 200 is released, from the fixing detecting part 137 and determine that the cleaner 200 is released.

When the control unit 400 determines that the cleaner 200 is released, the control unit 400 may stop the operation of the fixing part motor 133.

On the contrary, according to the embodiment, the control unit 400 may operate the door motor 142 for a preset time. For example, the control unit 400 may operate the door motor 142 in the reverse direction for a period of time of 4 seconds or more and 5 seconds or less and then stop the operation of the door motor 142.

According to the embodiment of the present disclosure, it is possible to achieve the above-mentioned object only by controlling the suction motor 214 of the cleaner.

When the dust collecting motor 191 operates, an airflow is formed in the first direction in the flow path part 180. When the airflow is formed in the first direction, the dust collected in the dust bin 220 flows to the dust collecting part 170.

When the suction motor 214 operates after the dust collecting motor 191 begins to operate, an airflow is formed in the second direction opposite to the first direction in the flow path part 180. When the airflow is formed in the second direction, the dust collected in the dust bin 220 flows to the dust collecting part 170.

According to the present embodiment, the suction force of the suction motor 214 is designed to be higher than the suction force of the dust collecting motor 191. Therefore, when the suction motor 214 and the dust collecting motor 191 operate simultaneously, the airflow is formed in the second direction in the flow path part 180.

According to the present embodiment, the flow direction may be changed only by controlling the suction motor 214 separately from the process of controlling the dust collecting motor 191. That is, the control units may be respectively disposed in the cleaner 200 and the cleaner station 100, the control unit disposed in the cleaner 200 turns on or off the suction motor 214 or changes the suction force of the suction motor 214 to change the flow direction, and the control unit may not be affected by the process of controlling the dust collecting motor 191 of the cleaner station 100. According to the present embodiment, the effect of the present disclosure may be implemented by the control unit disposed in the cleaner 200 even when the control unit disposed in the cleaner station 100 operates erroneously.

According to the embodiment of the present disclosure, the suction motor 214 may operate after the dust collecting motor 191 operates at least once. Therefore, after the dust collecting motor 191 operates first and removes the dust collected in the dust bin 220, only the remaining dust may be concentratedly removed.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

The invention claimed is:

1. A cleaner system comprising:

a cleaner comprising a dust bin configured to collect dust; and a cleaner station to which the cleaner is coupled, wherein the cleaner comprises a suction motor configured to generate a suction force so that air containing dust is introduced into the dust bin, wherein the cleaner station comprises:

a housing having a coupling part to which the cleaner is coupled, the housing having an internal space configured to accommodate a flow path part through which the dust in the dust bin flows; and a dust collecting motor disposed at a downstream side of the flow path part and configured to provide a suction force to the dust bin through the flow path part, wherein the dust collecting motor is configured to operate to cause air to flow from an interior of the dust bin toward an outlet of the dust bin facing the flow path part, and wherein the suction motor is configured to operate at least one time after the dust collecting motor begins to operate to cause air to flow from the outlet of the dust bin to flow into the interior of the dust bin, thereby reversing a direction of airflow in the dust bin.

2. The cleaner system of claim 1, wherein a flow direction of the dust in the flow path part changes reversely at least one or more times.

3. The cleaner system of claim 1, wherein at least any one of the suction motor and the dust collecting motor is controlled by being turned on or off.

4. The cleaner system of claim 1, wherein a suction force of the dust collecting motor changes at least one or more times after the dust collecting motor begins to operate.

5. The cleaner system of claim 1, wherein a direction of a suction force provided to the dust bin by the suction motor is opposite to a direction of a suction force provided to the dust bin by the dust collecting motor.

6. The cleaner system of claim 1, wherein the cleaner station comprises a door configured to open or close a dust passage hole formed in the coupling part, to which the cleaner is coupled, the dust passage hole being disposed between the dust bin and the flow path part, and wherein the door operates before at least any one of the suction motor and the dust collecting motor operates.

7. The cleaner system of claim 6, wherein the door operates to completely open the dust passage hole before the dust collecting motor operates, and wherein the door operates to open only a part of the dust passage hole before the suction motor operates after the dust passage hole is completely opened.

8. The cleaner system of claim 1, wherein operates consistently, and the suction motor is controlled by being turned on or off.

9. The cleaner system of claim 1, wherein the dust collecting motor is the dust collecting motor is controlled by being turned on or off, and the suction motor operates consistently.

10. The cleaner system of claim 1, wherein a rotational speed of the suction motor includes a first suction speed and a second suction speed lower than the first suction speed.

11. The cleaner system of claim 10, wherein the first suction speed and the second suction speed of the suction motor are alternately implemented, and the suction motor is turned off for a predetermined time before the rotational speed is changed.

12. The cleaner system of claim 11, wherein the dust collecting motor operates while the suction motor is turned off.

13. The cleaner system of claim 10, wherein the first suction speed and the second suction speed of the suction motor are alternately implemented, and the rotational speed is continuously changed for a predetermined time when the rotational speed is changed.

14. The cleaner system of claim 13, wherein a rotational speed of the dust collecting motor is lower than the first suction speed.

* * * * *